US008683700B1

(12) United States Patent
Kaidi et al.

(10) Patent No.: US 8,683,700 B1
(45) Date of Patent: Apr. 1, 2014

(54) NAIL CLIPPER WITH BLADE-INSERT

(76) Inventors: Alexandre Rachid Kaidi, San Rafael, CA (US); Hamid Reza Shamsapour, San Rafael, CA (US)

( * ) Notice: Subject to any disclaimer, the term of this patent is extended or adjusted under 35 U.S.C. 154(b) by 767 days.

(21) Appl. No.: 12/658,455

(22) Filed: Feb. 4, 2010

Related U.S. Application Data

(63) Continuation-in-part of application No. 11/305,561, filed on Dec. 15, 2005.

(51) Int. Cl.
*B26B 19/00* (2006.01)

(52) U.S. Cl.
USPC ..... 30/28; 30/29; 30/175; 30/179

(58) Field of Classification Search
USPC ..... 30/329, 330, 26, 27, 28, 29, 175, 176, 30/526
See application file for complete search history.

(56) References Cited

U.S. PATENT DOCUMENTS 3,832,771 A * 9/1974 Morgan ..... 30/28
4,637,137 A * 1/1987 Husain ..... 30/28
5,711,075 A * 1/1998 Wolf ..... 30/28
6,976,310 B1 * 12/2005 Sim ..... 30/28
2007/0137040 A1 * 6/2007 Schlipkoter et al. ..... 30/26
2008/0301946 A1 * 12/2008 Baek ..... 30/28
2009/0211098 A1 * 8/2009 Childs, II ..... 30/28
2011/0209348 A1 * 9/2011 McMullen, Jr. ..... 30/28
2012/0011723 A1 * 1/2012 Flaten ..... 30/28

* cited by examiner

*Primary Examiner* — Omar Flores Sanchez
(74) *Attorney, Agent, or Firm* — Risto A. Rinne, Jr.

(57) ABSTRACT

An apparatus for cutting toe nails and finger nails includes a plastic frame member. The frame member includes an upper frame member and a lower frame member. The upper and lower frame members are either attached together at a rear thereof or they are formed as a continuous component that generally includes a V-shape or a U-shape at the rear. One of a pair of cutting blades is attached to a front of the upper frame member and a remainder of the pair of cutting blades is attached to a front of the lower frame member so that a cutting edge of each of the pair of cutting blades will be in alignment and face each other. According to certain preferred embodiments, the device is disposable. According to certain other preferred embodiments each of the pair of cutting blades can be replaced with a new replacement blade assembly. A safety bumper prevents injury and provides a means for controlling the finished length of the nail. Various embodiments are shown sufficient to illustrate the benefits of having the plastic frame member align and support the disclosed novel steel blades which are considerably smaller, lighter, and less expensive to manufacture than the steel blades of prior opposing, non-overlapping blade types of nail clippers.

5 Claims, 8 Drawing Sheets

NAIL CLIPPER WITH BLADE-INSERT

This application is a continuation in part of currently patent application Ser. No. 11/305,561 and entitled "Nail Clipper with Blade-Insert" that was filed by the same applicants on Dec. 15, 2005, and the applicants claim the benefit of priority of the patent application Ser. No. 11/305,561 which was filed on Dec. 15, 2005.

BACKGROUND OF THE INVENTION

1. Field of the Invention

The present invention, in general, relates to personal grooming devices and, more particularly, to toe and finger nail clippers.

Nail clippers, the term herein including either toe or finger nail type of clippers, are generally well known.

Nail clippers have certain problems. For example, prior art designs tend to spray the clippings into a room. The clippings may be sharp and can even spread infection. Therefore, it is desirable to contain clippings.

However, prior art nail clippers include a center post that engages with a pivoting lever. The pivoting lever, pressing upon a ridge in the center post applies pressure to the clipper sufficient to urge a pair of opposite sides, and therefore also the blades, toward one-another during use. This is described in greater detail hereinafter.

The center post, though necessary, provides an obstruction that certain of the clippings inevitably must impact. The clippings bounce off of the center post and are scattered. Any prior art type of modification intended to retain the clippings has proven to be ineffective when they are bouncing off of the center post.

Other prior art types of nail clippers do not fold sufficiently flat for storage. Others do not apply leverage that can create sufficient force to cut through difficult nails without requiring a great deal of force by the user.

Additionally, prior art nail clippers include considerable metal that has been machined. This is considerably more expensive than plastic, for example. However, all prior art designs have heretofore included an all metallic nail clipper if opposing parallel blades are used, with perhaps some plastic surround components as well. This has been expensive to manufacture.

There is a need for an inexpensive nail clipper. There is a need for a disposable nail clipper that is also inexpensive. Such a device could be given away at finer hotels or sold for minimum cost. It could also be a free item that included advertising, for example.

Nail clippers are expensive because of the machining that is required to manufacture the metal portions thereof. The top and bottom blades must not only be cut to a fine edge, but they must align precisely so as to abut one-another when closed. It is relatively inexpensive to make a blade, but the manufacture of two opposing blades that mesh precisely together and abut each other when closed is what drives up the cost of manufacture of these types of prior art nail clippers. Additionally, each blade includes a remaining portion that forms one-half of a body of the prior art nail clipper. Each prior art blade is formed from a single piece of metal that includes two bends (radiuses) and a blade that has a cutting edge. Accordingly, the cost of manufacture is substantially increased. The construction of this common prior art type of nail clipper is described in greater detail hereinafter.

Also, because nail clippers include so much metal, they are detected at airport security checks and often result in the searching of personal sundries that would not otherwise be so scrutinized. The metallic nail clipper is typically taken away from the owner during a security screening. The owner is then faced with a return to a non-secure area and shipping the nail clipper from the airport, which typically takes over two weeks to arrive or loss of their nail clipper what would otherwise be confiscated by security personnel who have been instructed to view it as a potentially dangerous weapon which, of course, is a debatable assessment. Either way the all metallic nail clipper is likely to be detected and the owner will be without a nail clipper when they arrive at their intended destination.

It is desirable that a nail clipper include very little metal so that it does not register as a potential threat during airport check-in procedures. An acceptable amount is similar to the amount of metal found in a few coins, at most. Therefore, the ideal nail clipper would not include significantly more metal than that provided by the cutting blades.

As mentioned briefly before, a very common prior art type of a nail clipper includes a pair of opposing metallic blades that include a right angle radius and a remaining portion that extends to the rear of the nail clipper where the two remaining portions are joined together. Each of the opposing blades typically includes a slight curvature to correspond better with the curvature that most people prefer for their finished nails, although the opposing blades can include a cutting edge that is straight, if desired. A chord taken across the opposite ends of the cutting edge of each opposing blade is generally perpendicular with respect to a longitudinal axis of the remainder of the nail clipper.

The opposing blades are normally disposed in a parallel and spaced-apart relationship with respect to each other. A connecting post passes through an opening provided in an upper remaining portion. The post is attached to a lower remaining portion. A lever cooperates with an upper end of the post and bears upon an upper surface of the upper remaining portion. As the lever is urged toward the upper remaining portion it applies an upward force to the post and a corresponding downward force to the upper remaining portion that, together, urge the upper remaining portion and the lower remaining portion toward each other.

As the upper and lower remaining portions are urged together the cutting edges of both opposing blades are also urged toward each other. The cutting edges of the two opposing blades are in a spaced-apart parallel relationship with respect to each other when they are maximally disposed away from each other and they remain in a spaced-apart and parallel relationship with respect to each other as they are urged closer together. When the cutting edges of both of the opposing blades are urged fully toward each other the cutting edges abut each other and are parallel with respect to each other when they are in contact with each other. Accordingly, for this common prior art type of nail clipper the cutting edges of the blades are always parallel with respect to each other.

During use a finger nail or a toe nail is disposed between the two opposed blades when the lever is in a fully raised position and the two cutting edges are disposed maximally away from each other. As the two cutting edges are urged toward each other the nail is simultaneously being severed by each of the two cutting edges. Accordingly, the nail is being cut simultaneously on both sides of the nail. An audible snap is typically heard at the moment the nail is severed when the cutting edges of the opposing blades make contact with each other.

It is important to note that this type of prior art nail clipper experiences considerable mechanical stress (i.e., force-loading) as it cuts the nail because cutting is occurring simultaneously across the entire width of the cutting blade and also because cutting is occurring simultaneously on both sides of the nail. This has heretobefore required that the blades in their entirety and interconnecting portions of the prior art nail clipper be formed of steel to withstand the magnitude of the mechanical stresses (i.e., forces) that are experienced.

It is useful to consider that prior art types of metallic nail clippers that have a cutting edge which is perpendicular to the longitudinal axis of the clipper and that cut both sides (top and bottom) of the nail simultaneously actually can be considered as having two elongated blades. Each of the blades can be seen as including a cutting edge that is provided at a forward end of each blade.

As mentioned above, the two elongated blades each include a ninety degree bend proximate the cutting edge and the remaining portion of each cutting blade extends rearward to form the body of the nail clipper. Each of the two remaining portions are joined together at a rear of the remaining portion, often by spot welding or by the use of a fastener, with the cutting edges facing toward each other and disposed in a spaced-apart and parallel orientation. The metallic lever and post, as mentioned above, is used to draw the two cutting edges together.

An inherent spring constant of each remaining portion of the two extended blades is used to supply a force to urge the blades apart. By including a slight rear angle in the remaining portions prior to where the two remaining portions contact each other and are secured together, a distance between the two remaining portions increases from the rear of the nail clipper moving forward toward the cutting edges. By controlling the magnitude of the rear angle the maximum amount of gap between the opposing cutting edges is determined.

Each blade and each remaining portion of each blade is formed of a continuous piece of metal. The post of the prior art type of nail clipper is also formed of metal. Therefore all load bearing components that experience significant loading of these common prior art types of nail clippers are formed entirely of metal. Accordingly, in general the use of metal for these component parts of these prior art types of nail clippers have been the only way to provide the strength that is required to sever the nail across its width simultaneously along both the top and bottom of the nail.

Therefore, any of the known prior art types of nail clippers that is not formed entirely of metal (for the load-bearing components) or which includes an intermediate portion that is made from plastic or from some other non-metallic material and which supports the cutting blades must use a scissor-type (also known as a shear cut) of cutting action rather than the two opposing blades, as described above, which abut each other in order to withstand the magnitude of forces that are experienced during use. A scissor cut experiences considerably less stress that does the common prior art type of opposing parallel spaced-apart blade nail clipper because the nail is only being severed at a point when a scissor or shear cut is utilized. Severing the nail at a single point requires considerably less force than does severing the nail along the entire width of the nail simultaneously on both sides of nail. Severing the nail simultaneously along its width is a cutting of the nail along a line, either along a straight or a curved line depending on the shape of the cutting blades.

As the nail is continually sheared the point where the nail is being cut moves across the width of the nail, progressing further away from a pair of shear handles that control the shear blades. Therefore, considerably less mechanical stress is experienced by the prior art type of nail clipper utilizing a scissor cut than by the prior art type of nail clipper utilizing parallel opposing blades that cut simultaneously across the entire width of the blades. Because of the lower forces experienced by a scissor cut the prior art use of plastic members that support metal blades for a nail clipper has been possible.

It is, of course, possible to include plastic members that support metal blades which may abut each other along their cutting edges for very light duty low-stress cutting applications, but it has not heretobefore been possible to do so for any device intended to cut finger or toe nails. However, there has been a long standing need to provide a nail clipper for use with finger nails and toe nails that includes a body portion formed of a plastic for the reasons mentioned throughout this disclosure.

It is also useful to note that finger and toe nails can come in various thicknesses and that considerable force can be encountered when simultaneously cutting across the width of the blade and through especially thick nails as can occur, for example, by nails that have been compromised by fungal infection. This can further increase the loading that is experienced by a nail clipper.

However, a significant first disadvantage to a shear type of cut as found with any prior art nail clipper that includes a plastic member to support a metallic cutting blade is that a shear includes a wide opening into which a user can over insert the tip of their finger or toe and risk cutting of the fleshy part of the finger tip or tip of the toe during insertion. This problem is especially acute for the visually impaired and for those with other disabilities.

Preventing cutting of the fleshy part of the finger or toe is an important consideration. While prior art types of spaced-apart opposing parallel cutting edge (blade) nail clippers provide some benefit over shear types of nail clippers it is still possible to over insert the nail and cut the fleshy part of the finger or toe. Also, the quality of cut is likely to vary from nail to nail as some nails are likely to be cut shorter while others are cut longer.

People desire a nail clipper that provides a constant depth of cut from nail to nail for optimum appearance and they want to minimize and preferably eliminate the possibility of cutting the finger. For example, people typically desire that their nails be of equal length after cutting to provide a uniform appearance. Also, people may desire that a predetermined amount of the lighter portion that is common at the tip of the nail to remain after cutting. A type of cut that provides this appearance is commonly referred to as a "French manicure".

Accordingly, it is not possible for unskilled users of any type of prior art nail clipper to prevent the possibility of cutting the fleshy tip of the finger or toe and it is not possible to precisely control the depth of cut from nail to nail or provide a French manicure. Therefore, many people pay a manicurist to provide these services. However, this is challenging even to a skilled manicurist and especially so to a manicurist of lesser skill. Even a manicurist could benefit from the use of a nail clipper or set of nail clippers that each include means for controlling the depth of cut.

A second significant disadvantage to the use of a shear cut (of any prior art device intended for cutting finger/toe nails) is that the user must exert and maintain considerable force at all times while urging the nail in a direction that is toward the intersecting cutting edges of the shear type of nail clipper. This is necessary because as the shear blades are drawn together they create an angle of intersection between the two shear blades that applies a force (i.e., a force vector) to the nail which tends to urge the nail away from the point of intersection as the blades are drawn closer together.

In order to cut the nail with a scissor or shear type of cut the user must simultaneously close the shears while supplying a force urging the nail toward the shear blades. This effect is not noticeable when cutting a sheet of paper using paper shears. This is because the paper is easy to cut and thin. Being thin, the shear blades tend to be disposed at a less severe angle at the point of cut than they would if the paper (or object being cut) were thicker. Therefore, a greater percentage of the force applied to the paper by the shears is in a downward direction while less of the force is applied to the paper in a horizontal direction. However, a finger nail or toe nail is considerably harder and thicker than is a sheet of paper. Accordingly, the horizontal force component that is applied to the nail by the shear blades and which tends to urge the finger or toe nail away from the shear blades is considerably greater when cutting finger or toe nails than when cutting through paper with a pair of scissors.

Not only is this difficult to coordinate, but there is considerable risk that the nail could be urged away from a position of contact with the shear blades for any of several possible reasons. If the user is cutting a small amount of finger nail, for example, the small amount of nail could suddenly be severed simply by urging the nail toward the shear blades. The moment the nail is severed an acceleration of the finger will occur that can drive the fleshy part of the finger that is near the nail into the cutting edges of the shear blades. The finger can be cut, perhaps severely so. If the nail is urged away from contact with the shear blades because the user is unsteady, the same risk of cutting the finger arises. While this is difficult for users in general it is especially difficult for those with impaired vision or diminished hand-eye motor control to accomplish. For example, people in hospitals, nursing, and convalescent homes are unable to use shear type nail clippers for these reasons.

Accordingly, there is a long-standing need to provide a nail clipper with opposing parallel cutting blades that abut each other that is safe to use.

Also, there is a long-standing need to provide a nail clipper with opposing parallel cutting blades that abut each other that includes less metal.

Also, in nursing and convalescent homes for the reasons mentioned herein, shears cannot be provided for the residents to trim their own nails, less they injure themselves. However, the prior art nail clippers that include opposing parallel cutting blades that abut each other are too expensive to routinely provide to the residents. Also, it is possible to over-insert a finger into the prior art nail clippers that include opposing parallel cutting blades that abut each other when closed and to cut the fleshy part of the finger. For this reason, the residents are often prevented from cutting their own nails and must rely on assistance from staff to cut their nails.

Also, due to failing memory, the residents are apt to lose or to leave their own personal nail clippers (typically provided by family members) in community areas. The staff, upon finding such a nail clipper, is often unable to determine the correct owner and is reluctant to guess and provide a found nail clipper to the wrong person because of the risk of spreading viruses, bacteria, and fungal infections.

Accordingly, there is a need for a low cost nail clipper that includes opposing parallel cutting blades which abut each other that is low in cost. Similarly, there is a need for a nail clipper that includes opposing parallel cutting blades which abut each other that can be readily identified. For example, a plastic body could be provided in a variety of colors or designs to provide a visual means of identification. Similarly, a plastic body of a nail clipper could be written on by the use of a permanent market to identify the owner. Additionally, a plastic body could include Braille markings to identify ownership or any other desired attribute of the nail clipper.

Accordingly, there is also a long standing need to provide a means for controlling the depth of cut of a finger (or toe) nail by a nail clipper of the type that includes opposing parallel cutting blades which abut each other. Similarly, there is a need to provide a set of nail clippers that each include means for controlling the depth of cut of a finger (or toe) nail and where each clipper provides a different depth of cut. Additionally, there exists a need to provide a means for indicating the degree of depth of cut on a nail clipper that limits the depth of cut. There is a need to identify the depth of cut of a nail clipper by visual or by tactile means.

Accordingly, there exists today a need for a nail clipper with blade-insert that helps ameliorate the above-mentioned problems and other difficulties.

Clearly, such an apparatus would be a useful and desirable device.

2. Description of Prior Art

Nail clippers are, in general, known. While the structural arrangements of the above described known types of devices may, at first appearance, have similarities with the present invention, they differ in material respects. These differences, which will be described in more detail hereinafter, are essential for the effective use of the invention and which admit of the advantages that are not available with the prior devices.

U.S. Pat. No. 7,210,230 to Wurzel, that issued on May 1, 2007;

U.S. Pat. No. 7,020,964 to Han, et al., that issued on Apr. 4, 2006;

U.S. Pat. No. 6,941,657 to Choi, et al., that issued on Sep. 13, 2005;

U.S. Pat. No. 5,964,033 to Wolf, that issued on Oct. 12, 1999;

U.S. Pat. No. 5,621,974 to Rose, et al., that issued on Apr. 22, 1997;

U.S. Pat. No. 5,488,772 to Dababneh, et al., that issued on Feb. 6, 1996;

U.S. Pat. No. 5,353,505 to Okada, that issued on Oct. 11, 1994;

U.S. Pat. No. 5,331,739 to Basangy, that issued on Jul. 26, 1994;

U.S. Pat. No. 5,074,041 to Wagner, that issued on Dec. 24, 1991;

U.S. Pat. No. 4,819,673 to McMullen, Jr., that issued on Apr. 11, 1989;

U.S. Pat. No. 4,776,090 to Grassi, that issued on Oct. 11, 1988;

U.S. Pat. No. 4,130,937 to Kim, that issued on Dec. 26, 1978;

U.S. Pat. No. 3,914,866 to Applegate, that issued on Oct. 28, 1975;

U.S. Pat. No. 796,389 to Wright, that issued on Aug. 1, 1905; and

U.S. Pat. No. 327,065 to Burton, that issued on Sep. 29, 1885.

OBJECTS AND SUMMARY OF THE INVENTION

It is an object of the present invention to provide a nail clipper with blade-insert that is inexpensive to manufacture.

It is also an important object of the invention to provide a nail clipper with blade-insert that includes a replaceable cutting edge.

Another object of the invention is to provide a nail clipper with blade-insert that is primarily made of a plastic, nylon, or polymer.

Still another object of the invention is to provide a nail clipper with blade-insert that is aesthetically attractive.

Still yet another object of the invention is to provide a nail clipper with blade-insert that is sufficiently inexpensive to manufacture as to be disposable.

Yet another important object of the invention is to provide a nail clipper with blade-insert that includes a small cutting edge in a plastic frame.

Still yet another important object of the invention is to provide a nail clipper with blade-insert that includes a plastic frame that is attractive.

A first continuing object of the invention is to provide a nail clipper with blade-insert that is available in a desired color.

A second continuing object of the invention is to provide a nail clipper with blade-insert that is lightweight.

A third continuing object of the invention is to provide a nail clipper with blade-insert that includes a blade that is formed of a metallic or other suitable material and a second blade that is formed of a metallic or other suitable material and wherein the blade and the second blade are not formed of a continuous piece of material.

A fourth continuing object of the invention is to provide a nail clipper with blade-insert that includes a blade which is formed of metal and wherein the blade does not include a remaining portion that extends to a rear of the nail clipper that is made from metal.

A fifth continuing object of the invention is to provide a nail clipper with blade-insert that includes a blade which is formed of metal and wherein the blade of the inventive nail clipper does not include a remaining portion that extends to a rear of the nail clipper that is made from metal, and further wherein the blade and the remaining portion of the inventive nail clipper are not formed from a continuous piece of metal.

A sixth continuing object of the invention is to provide a nail clipper with blade-insert that includes a blade which is formed of metal and a remaining portion that extends to a rear of the nail clipper and wherein the remaining portion is made from plastic, and wherein the blade is secured to the plastic at an end of the clipper that is opposite with respect to the rear of the nail clipper.

A seventh continuing object of the invention is to provide a nail clipper with blade-insert that includes a safety bumper that helps prevent a cutting of the fleshy part of the finger or toe.

An eighth continuing object of the invention is to provide a nail clipper with blade-insert that includes a safety bumper that provides a consistent depth of cut resulting in a more uniform appearance from nail to nail.

A ninth continuing object of the invention is to provide a nail clipper with blade-insert that includes a safety bumper with a predetermined length of protrusion that extends forward from a cutting edge of a blade and which is able to contact a fleshy part of a finger or toe during use, and wherein the contact limits the amount a nail can be inserted between two opposing blades of the nail clipper to regulate the depth of cut of the nail.

A tenth continuing object of the invention is to provide a nail clipper with blade-insert that includes a safety bumper with a predetermined length of protrusion which extends forward from a cutting edge of a blade and that provides a depth of cut that is dependent on the amount of protrusion.

An eleventh continuing object of the invention is to provide a nail clipper with blade-insert that includes a safety bumper with a predetermined length of protrusion which extends forward from a cutting edge of a blade and that provides a depth of cut that is proportional to the length of protrusion.

A twelfth continuing object of the invention is to provide a nail clipper with blade-insert that includes a plurality of nail clippers which each include a different length of protrusion that extends forward from a cutting edge of a blade.

A thirteenth continuing object of the invention is to provide a nail clipper with blade-insert that includes a plurality of nail clippers which each nail clipper including a different length of protrusion that extends forward from a cutting edge of a blade in a set of nail clippers and which allows selection of a particular nail clipper from the set to provide a desired depth of cut of the nail.

A fourteenth continuing object of the invention is to provide a nail clipper with blade-insert that includes a blade that can be formed of flat stock and bent to fit around a plastic member.

A fifteenth continuing object of the invention is to provide a nail clipper with blade-insert that includes a safety bumper with a predetermined length of protrusion which extends forward from a cutting edge of a blade and wherein the nail clipper includes a plastic member to which a metal blade is secured.

A sixteenth continuing object of the invention is to provide a nail clipper with blade-insert that includes a safety bumper with a predetermined length of protrusion which extends forward from a cutting edge of a blade and wherein the nail clipper includes a plastic member, and wherein the plastic member includes means for visually identifying a depth of cut or other attribute of the nail clipper.

A seventeenth continuing object of the invention is to provide a nail clipper with blade-insert that includes a safety bumper with a predetermined length of protrusion which extends forward from a cutting edge of a blade and wherein the nail clipper includes a plastic member, and wherein the plastic member includes tactile means for identifying a depth of cut or other attribute of the nail clipper.

Briefly, a nail clipper with blade-insert that is constructed in accordance with the principles of the present invention has a plastic frame with a pair of cutting blades that are attached to the plastic frame and face each other. A safety bumper is described that controls the depth of cut of a finger or toe nail relative to a fleshy tip of the finger or toe and which helps to prevent cutting of the fleshy part of the finger or toe. If desired, the safety bumper also provides structural support for the cutting blades. According to a preferred embodiment the pair of cutting blades can be replaced with new blades. According to another preferred embodiment, the device is disposable. Various embodiments are shown to illustrate some of versatility and benefits that are possible. All of the embodiments disclosed herein appertain to a general type of nail clipper having a basic structure as defined by the remainder of this paragraph. All embodiments include a pair of opposing blades. Each of the two opposing blades includes a cutting edge. The two cutting edges are identically shaped with respect to each other and face each other. The cutting edges are disposed in a parallel, spaced-apart relationship with respect to each other when the opposing blades are disposed maximally away from each other which occurs when the opposing blades are not being urged toward each other. When a force is applied to urge the opposing blades maximally toward each other each cutting edge will come into contact with and abut the identically-shaped cutting edge of the opposing blade along the length of the cutting edges. The cutting edges of the opposing blades are maintained in parallel relationship with respect to each other when they are disposed maximally away from each other, when they abut each other, and when they are disposed at any intermediate distance between being disposed maximally away from each other and being in contact with each other. A finger nail or toe nail is inserted between the cutting edges when they are disposed maximally away from each other. The cutting edges are then urged toward each other. As the cutting edges are urged toward each other the upper cutting edge begins to sever (i.e., cut) a first side of the nail as the lower cutting edge simultaneously begins to sever an opposite second side of the nail. Increasing force is applied to continue urging the cutting edges toward each other until the opposing cutting edges have simultaneously severed both sides of the nail and have come into contact with one-another along their length. A chord that is taken across the ends of the cutting edges (if the cutting edges are curved) or a line that is parallel to the cutting edges (if the cutting edges are straight) is perpendicular with respect to a longitudinal axis that passes through a main body of any version of the nail clipper with blade-insert.

Figure 2:
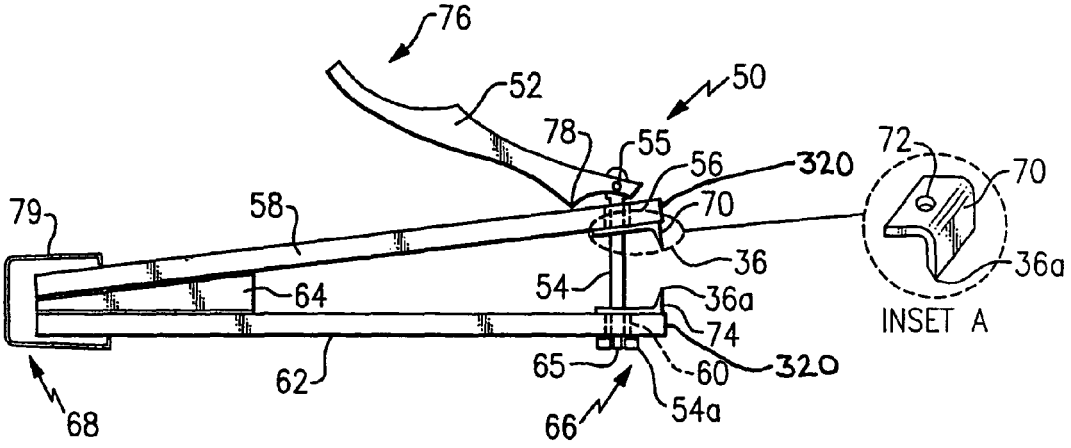
FIG. 2 is a side view of a second disposable type of a nail clipper with blade-insert.

INSET A is an enlarged view in perspective of a first modified blade of FIG. 2.

Figure 3:
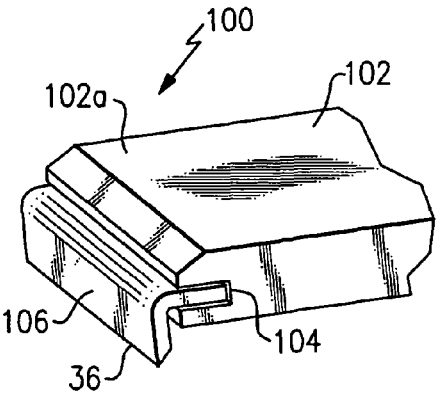

FIG. 3 is a view in perspective of a portion of a first half of a third disposable type of a nail clipper with blade-insert.

Figure 4:
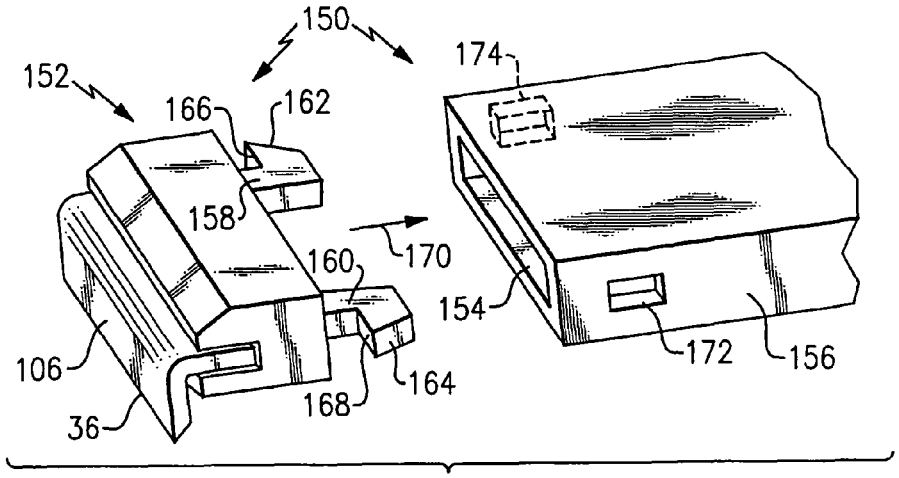

FIG. 4 is a view in perspective of a portion of a first half of a first replaceable blade type of a nail clipper with blade-insert with a replacement blade ready for insertion.

Figure 5:
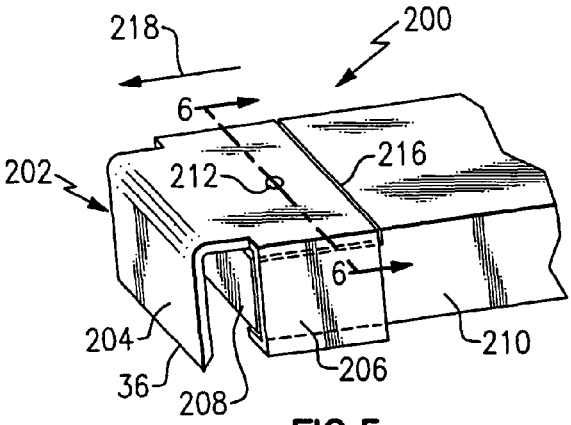

FIG. 5 is a view in perspective of a portion of a first half of a second replaceable blade type of a nail clipper with blade-insert with a replacement blade installed.

Figure 6:
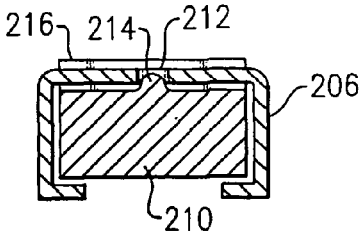

FIG. 6 is a cross-sectional view of the device of FIG. 5 taken along the line 6-6 in FIG. 5.

Figure 7:
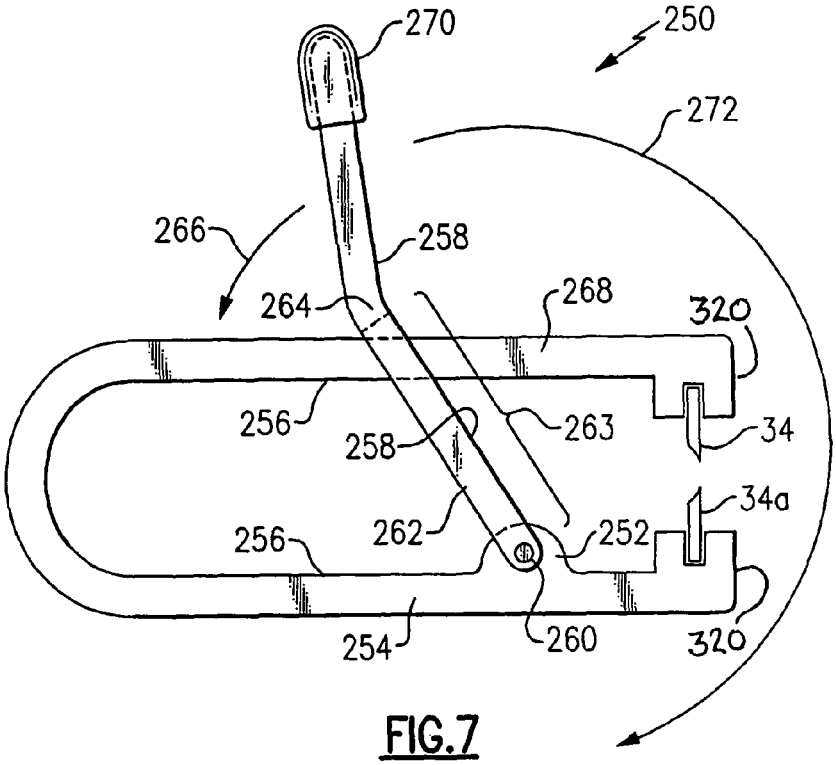

FIG. 7 is a side view of a fourth disposable type of a nail clipper with blade-insert.

Figure 8:
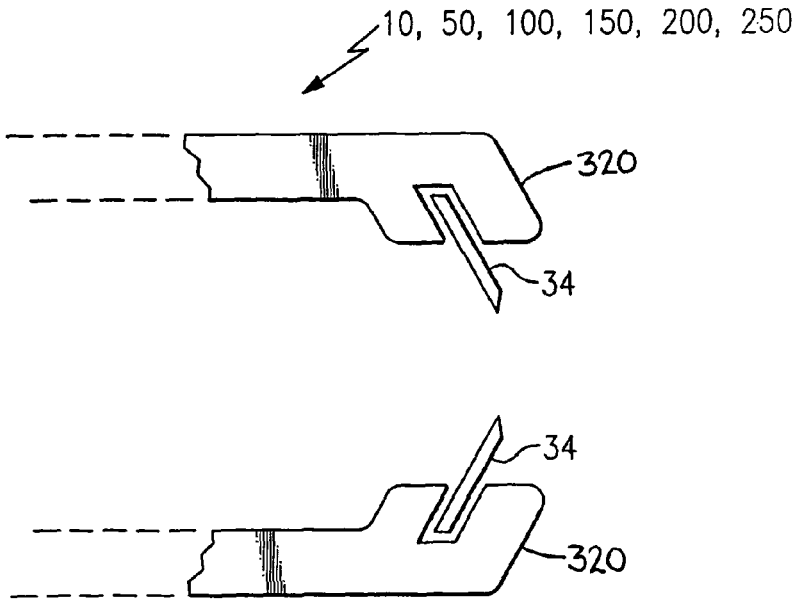

FIG. 8 is a side view of a modified way of mounting a cutting blade to a nail clipper with blade-insert.

Figure 9:
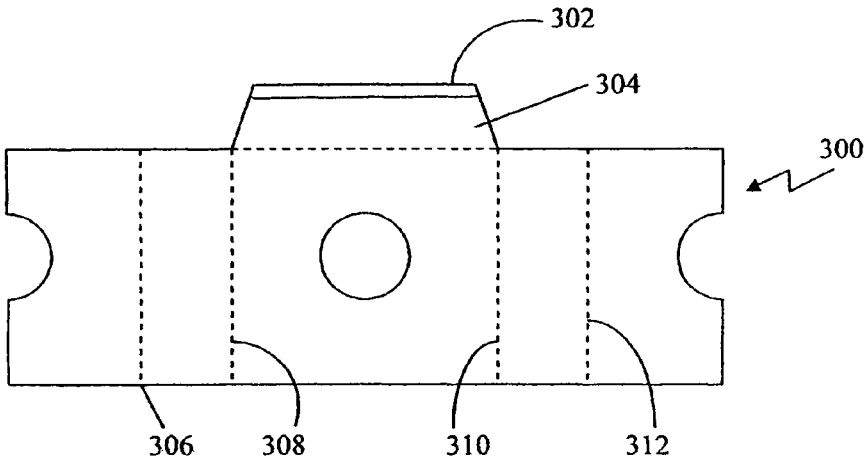

FIG. 9 is top plan view of a blade formed from a flat stock of material prior to bending.

Figure 10:
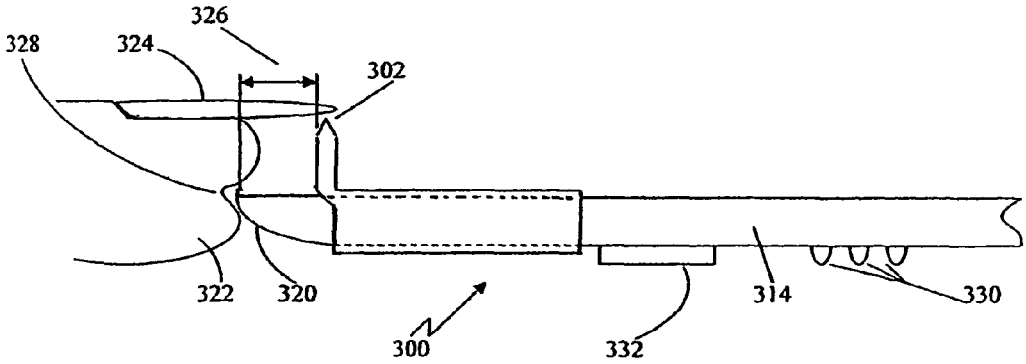

FIG. 10 is a side view of a portion of a half of a nail clipper with the blade of FIG. 9 after the blade has been bent and secured to a member of a modified nail clipper with blade-insert.

Figure 11:
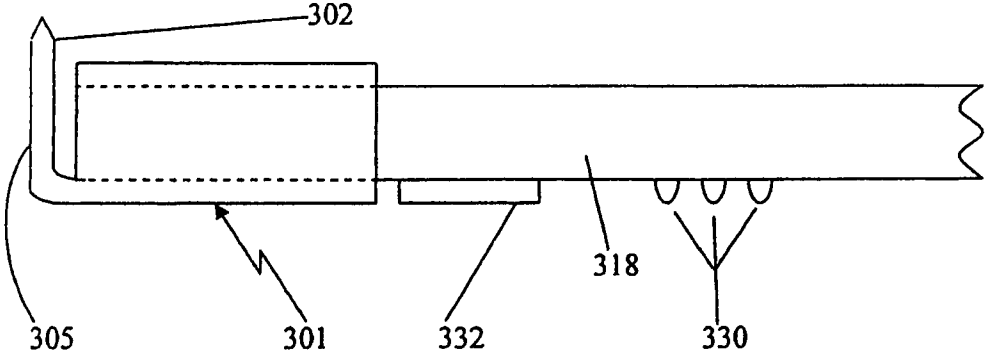

FIG. 11 is a side view of a portion of a half of a nail clipper with a slightly modified blade as shown in FIG. 9 wherein the blade includes a longer blade portion and is bent in an opposite direction.

Figure 12:
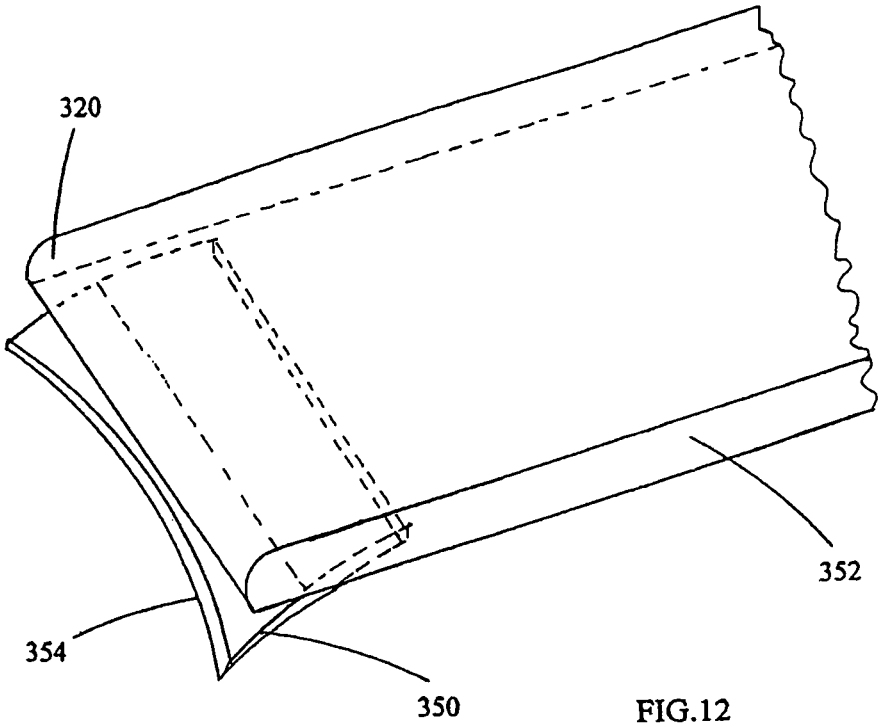

FIG. 12 is a view in perspective of a forward projecting blade with a safety bumper.

Figure 13:
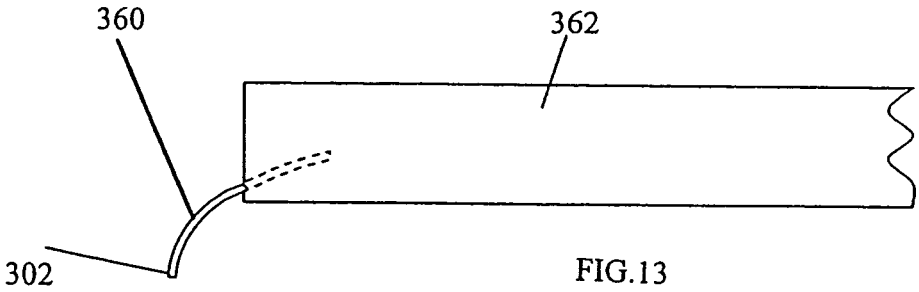

FIG. 13 is a side-view of an embedded blade that extends out of a forward end of a square-end plastic member.

Figure 14:
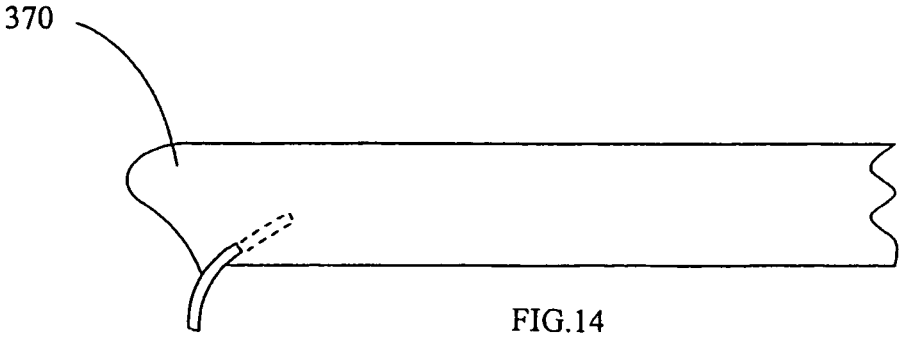

FIG. 14 is a side-view of a modification that has been made to the square-end plastic member of FIG. 13 to include a modified protrusion.

Figure 15:
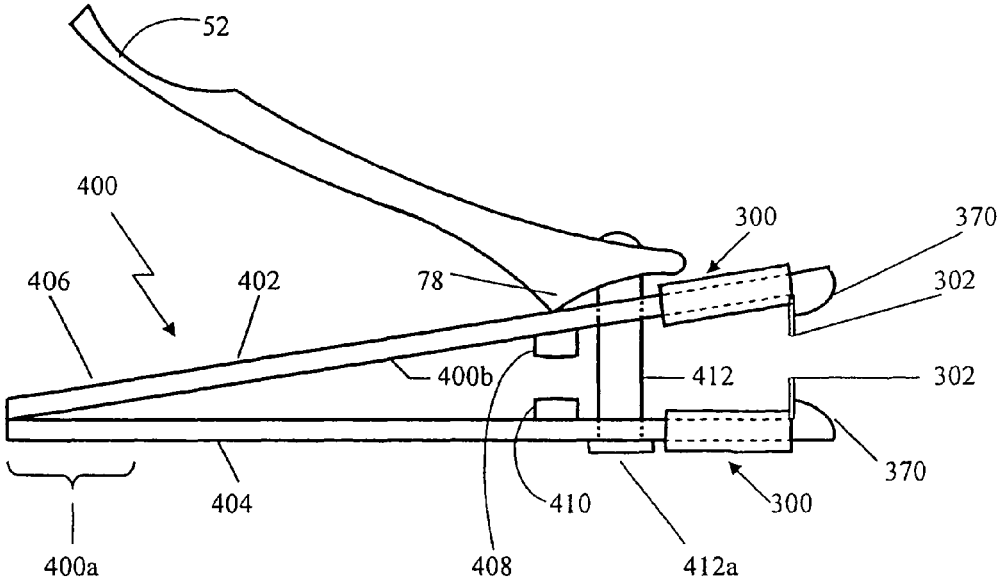

FIG. 15 is a side-view of a further modified nail clipper that includes slight modifications made to the nail clipper with blade insert of FIG. 2.

Figure 16:
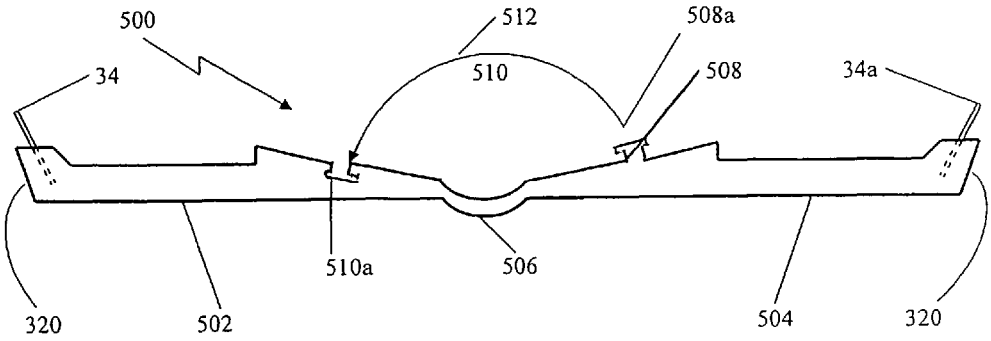

FIG. 16 is a side view taken along a center longitudinal cross-section of a hinged nail clipper that includes a one-piece plastic body.

Figure 17:
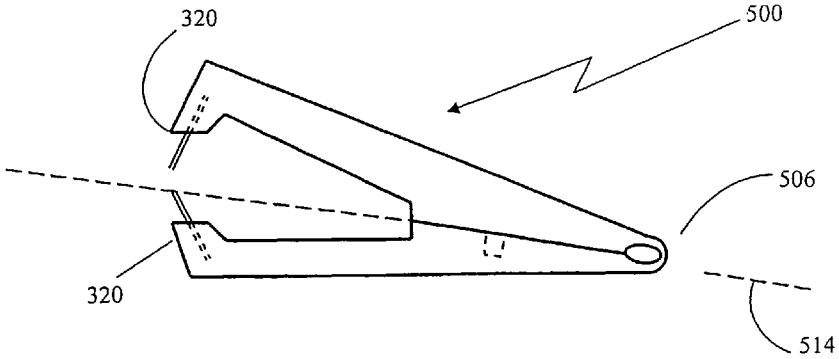

FIG. 17 is a side view of the hinged nail clipper of FIG. 16 assembled and ready for use.

DETAILED DESCRIPTION OF THE INVENTION

Figure 1:
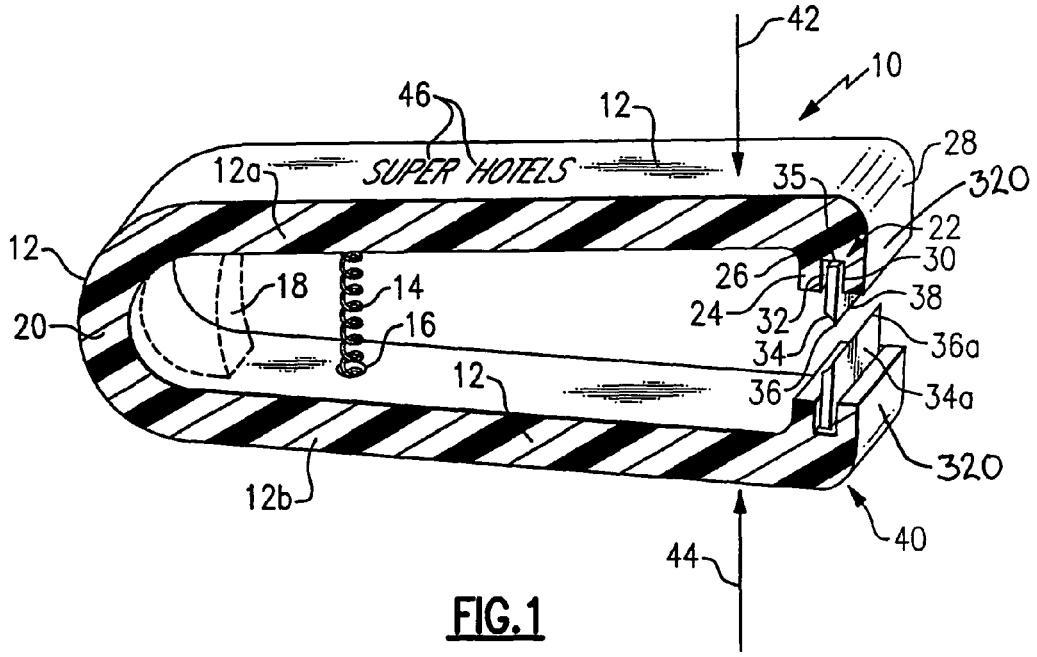
FIG. 1 is a view in perspective of a first disposable type of a nail clipper with blade-insert.

Referring to all of the drawing FIGURES and now primarily to FIG. 1 is shown, a first disposable type of a nail clipper with blade-insert, identified in general by the reference numeral 10.

A one-piece plastic frame member 12 is molded out of a sufficient grade of plastic, nylon, or other material other than a metal.

A spring 14 is provided to push an upper half 12*a* of the frame member 12 away from a bottom half 12*b*. The spring 14 fits into a hole 16 provided in the bottom half 12*b* and a similar hole (not shown) that is provided in the top half 12*a*.

If desired, a greater amount of plastic material 18 (shown in dashed lines) is provided near a rear 20 of the frame member 12. The plastic material 18 is used instead of the spring 14 to urge the bottom half 12*b* away from the upper half 12*a* when no force is applied to any portion of the frame member 12.

If desired, other types of springs (not shown) can be used.

The upper half 12*a* of the frame member 12 of the first disposable type of a nail clipper with blade-insert 10 includes a first enlarged front portion, identified in general by the reference numeral 22.

The first enlarged front portion 22 includes a vertical section 24 that is generally perpendicular to a longitudinal axis of the upper half 12*a*. An inside radius 26 connects the vertical section 24 with the upper half 12*a* along an inside surface of the first disposable type of a nail clipper with blade-insert 10. An outside radius 28 similarly connects the vertical section 24 with the upper half 12*a* along an outside surface of the first disposable type of a nail clipper with blade-insert 10.

A first recess 30 is provided in a bottom surface 32 of the vertical section 24 that extends across the width thereof. The first recess 30 can be straight or it may include a curve, as desired.

A blade 34 is inserted into the first recess 30 and is held in place by friction or by any preferred method or combination of methods, as desired. For example, holes (not shown) can be provided through the blade 34. Plastic material from the vertical section 24 can extend through the holes sufficient to secure the blade 34 precisely in position. If desired, an adhesive 35 may be used.

The blade 34 includes a small piece of planar material with a cutting edge 36 that is disposed closest toward the bottom half 12*b*. The blade 34 is preferably formed of metal, although other materials, for example a ceramic material, can be used, if desired. The blade 34 preferably includes a curvature 38 along the cutting edge 36 as is common with prior art types of nail clippers (not shown).

The blade 34 small piece of planar material is sharpened and bent (if desired) prior to insertion into the first recess 30. As such, the cost of manufacture of the blade 34 is minimal.

The bottom half 12*b* includes a second enlarged front portion, identified in general by the reference numeral 40. The second enlarged front portion 40 is a mirror in construction and composition to the first enlarged front portion 22.

A second blade 34*a* of the second enlarged front portion 40 is identical to the blade 34, just oriented upside down with respect thereto.

A second cutting edge 36*a* of the second blade 34*a* aligns with the cutting edge 36 when the upper half 12*a* and the bottom half 12*b* of the frame member 12 are urged together.

The upper half 12*a* and the lower half 12*b* are urged toward each other when a force sufficient to overcome hysteresis and the force of the spring 14 is applied to the upper half 12*a* in the direction and location of arrow 42 and to the bottom half 12*b* in the direction and location of opposite arrow 44.

When urged together, the cutting edge 36 and the second cutting edge 36*a* align perfectly with respect to each other.

A finger nail (324 FIG. 10) or a toe nail (not shown) is inserted between the blade 34 and the second blade 34*a* (or between the blades of any embodiment) and is severed by the cutting edge 36 and by the second cutting edge 36*a* when sufficient force is applied to urge the upper half 12*a* and to the bottom half 12*b* toward each other.

Therefore, as the cutting edge 36 and the second cutting edge 36*a* are urged toward each other, the finger nail 324 is being severed on a first side by the cutting edge 36, and the finger nail 324 is also simultaneously being severed on an opposite second side by the second cutting edge 36*a*. After sufficient force has been applied (either by hand or by a mechanical advantage supplied by a lever, as described in greater detail hereinafter) the cutting edge 36 and the second cutting edge 36*a* are drawn together until they eventually contact each other along the length of the cutting edges 36, 36*a*, at which time an outer portion of the finger nail 324 will have been severed apart from a remainder of the finger nail 324.

It is important to note that the cutting edge 36 and the second cutting edge 36*a* abut each other. They do not overlap one-another. Accordingly, there is no shear action that occurs with any embodiment of the instant invention as occurs with a (common) pair of household scissors or shears (not shown). A scissor-cut (i.e., a shear cut) is undesirable for use in cutting the finger nail 324 (or toenail) for several reasons. If attempting to cut a finger nail 324 with a shear-type of cutting action the user must constantly apply a force urging the finger nail 324 toward the intersecting (i.e., pivot) point of the shears to counteract a force that the shears are applying to the finger nail 324.

As the shear blades are drawn together they create a force vector in a direction that is urging the finger nail 324 away from the intersecting point. If the user did not apply the counteracting force the finger nail 324, being relatively hard, would be urged away from the intersecting point and it would not be severed.

Not only is it difficult for the user to apply and maintain the (counteracting) force but there is considerable danger that the position of the finger nail 324 with respect to the shear blades might suddenly slip. The user could then impact the sharp cutting edges of the shear blades with the fleshy part of the finger. This could result in minor to severe injury (cutting) of the finger.

There is another significant disadvantage associated with the use of a scissor-type cutting action for severing finger or toe nails. During use shear blades must be opened and disposed at angle with respect to each other. The fingernail 324 is placed between the shear blades so that it contacts the shear blades near their point of intersection. A significant portion of the shear blades will extend outward beyond the thickness of the finger nail 324 and along the angle between the shear blades. This provides an opening that is considerably larger than is the thickness of the finger nail 324. When a slip occurs, the excessive size of the open shear blades permits entry of the finger and contact with the cutting edges of the shear blades by any portion of the finger (or fingers). Therefore, injury can occur to the fingers well beyond the thickness of the finger nail 324. By way of contrast, only a small opening for insertion of the finger nail 324 is provided by any embodiment of the instant invention. This is described in greater detail, hereinafter.

It is noted that all embodiments described herein resemble in some very general ways the structure of a prior art type of nail clipper that includes opposing metal blades and a metal body. As described hereinafter in greater detail, the all-metal construction was required to withstand the forces involved. The disclosure herein overcomes the prior art limitations to allow for construction of the instant invention without the use of metal for the members that extend and support the blades 34, 34*a* (or any of the other blades 106, 152, 202, 300, 301, as described herein).

All embodiments of the instant invention resemble in only these very general ways the prior art all-metal type of nail clipper in that they include two opposing blades 34, 34*a* with each blade 34, 34*a* having a cutting edge 36, 36*a* at an end thereof. The two cutting edges 36, 36*a* of all embodiments (and the prior art device) face each other. The two cutting edges 36, 36*a* are either curved or straight but for any given embodiment they are identically shaped with respect to each other. Like the prior art device, the cutting edges 36, 36*a* are disposed in a parallel, spaced-apart relationship with respect to each other whenever the opposing blades 34, 34*a* are disposed away from each other. When the opposing blades 34, 34*a* of the instant invention (and the prior art device) are urged together the cutting edges 36, 36*a* contact one-another along their length. There is no overlap of the cutting edges 36, 36*a*. Therefore, the two cutting edges 36, 36*a* are always in a parallel relationship with respect to each other for the instant invention (and the prior art device). A chord that is taken across the ends of the cutting edges 36, 36*a* (if the cutting edges 36, 36*a* are arcuate) or a line that is parallel to the cutting edges 36, 36*a* (if the cutting edges are straight) is perpendicular with respect to a longitudinal axis 514, (FIG. 17) that passes through a main body of any embodiment of the instant invention (and the prior art device).

Referring again to FIG. 1, typically, a thumb and finger of a user can supply sufficient force to sever the nail 324. If desired, the first disposable type of a nail clipper with blade-insert 10 is modified to include a lever 52 (see FIG. 2) to apply greater force to urge the cutting edge 36 and the second cutting edge 36*a* together. FIG. 2 also illustrates that the one-piece frame member 12 can be modified to include two pieces, as described in greater detail hereinafter. The use of one or two pieces for the frame member 12 is possible for any embodiment of the invention.

If desired, an advertisement 46 is provided wherever preferred on the frame member 12.

Because the cost of manufacture is so little for the first disposable type of a nail clipper with blade-insert 10, they can be sold at very low cost, used for a period of time until the cutting edge 36 and the second cutting edge 36*a* become dull, and then disposed of.

If the spring 14 is eliminated, other than the blade 34 and the second blade 34*a* there is no metal. Of course, the spring 14 could be changed from a coil-type of the spring 14 to include a leaf-type of the spring 14 that is disposed further toward the rear of the nail clipper with blade-insert 10 (not shown) than is the spring 14, as shown. This makes the first disposable type of a nail clipper with blade-insert 10 lightweight and very inexpensive to manufacture.

Unlike all known prior art types of nail clippers, the blade 34 and the second blade 34*a* are separate parts. They are not formed of a continuous piece of metal (as is the prior art). Because the blade 34 and the second blade 34*a* are not continuous, precision machining of the each prior art cutting edge with respect to the other is eliminated.

This greatly reduces the cost of manufacture because the blade 34 and the second blade 34*a*, being separate components, are easy to manufacture and to machine the cutting edge 36 and the second cutting edge 36*a*.

Luxury hotels can provide the first disposable type of a nail clipper with blade-insert 10 for free or at low cost. Manufacturers of any type of a product who wish to increase customer awareness of their products (or services) can include their name, telephone number, and website as part of the advertisement 46. The manufacturers may wish to give the first disposable type of a nail clipper with blade-insert 10 away for free.

Every time a person who has received one for free cuts his or her finger nails or toe nails, they are apt to be reminded of the manufacturer and to think favorably of the manufacturer. If repeated enough times, when a purchase decision is required by the person for a product offered by the manufacturer, it is likely that the name of the manufacturer will spring favorably to mind.

The frame member 12 can be any desired color of plastic. For example, a pink color of the frame member 12 may appeal to girls and women whereas another color may be more likely to appeal to boys and men.

Furthermore, because there is so little metal, airport security devices are not likely to detect the first disposable type of a nail clipper with blade-insert 10 during security screening. This prevents delays and possible confiscation of the first disposable type of a nail clipper with blade-insert 10 by overly zealous security personnel.

Referring now primarily to FIG. 2 is shown, a second disposable type of a nail clipper with blade-insert, identified in general by the reference numeral 50.

A plastic lever 52 is pivotally attached to a top of a vertical plastic pin 54 by a horizontal pin 55. The pin 54 passes through a pin hole 56 provided in a first modified frame member 58. If desired, the pin 54 can be formed of a metal or material other than plastic.

The pin 54 continues to pass through a second pin hole 60 provided in a second modified frame member 62. The first modified frame member 58 and the second modified frame member 62 are identical, just inverted with respect to each other. They are each formed of plastic or nylon preferably and include a center wedge 64 at an end opposite to where the pin 54 is disposed.

The pin 54 includes a split bottom 54*a*. The two opposite sides of the split bottom 54*a* are urged together sufficient to pass through the second pin hole 60. A pin wedge 65 is urged into the split bottom 54*a* sufficient to spread the two opposite sides of the split bottom 54*a* apart an amount sufficient to prevent the split bottom 54*a* from passing back up and through the second pin hole 60. There are, of course, ways of securing the pin 54 or a modified type of pin (not shown) other than by the use of the split bottom 54*a*.

The first modified frame member 58 and the second modified frame member 62 are preferably planar members that approximate the size of current prior art types of nail clippers. Prior art types of nail clippers come in a variety of sizes and it is to be understood that the instant invention can similarly be provided in a variety of sizes.

The wedge 64 is either welded (by ultrasound or other means) or adhered (by an adhesive) to the first modified frame member 58 and to the second modified frame member 62. Injection molding or other known or future manufacturing techniques can, of course, be used to form any version of the nail clipper with blade-insert 10, 50 (100, 150, 200, as described hereinafter).

The wedge 64 orients the first modified frame member 58 and the second modified frame member 62 in a spaced apart relationship where they are disposed further apart at a front, identified in general by the reference numeral 66 than at an opposite rear 68. If desired, the wedge 64 is molded as an integral part of the second disposable type of a nail clipper with blade-insert 50 so that the wedge 64, the first modified frame member 58, and the second modified frame member 62 are one continuous piece.

A first modified blade 70 includes a blade hole 72 through which the pin 54 passes. The first modified blade 70 includes the cutting edge 36 which is substantially identical to that of the first disposable type of a nail clipper with blade-insert 10. The first modified blade 70 is attached at the front 66 of the first modified frame member 58 by adhesive or any preferred means.

A second modified blade 74 is identical to the first modified blade 70 and is similarly attached in an inverted fashion to the second modified frame member 62 so that the cutting edge 36 and the second cutting edge 36*a* of the second modified blade 74 are aligned with respect to each other and face each other, as they did on the first disposable type of a nail clipper with blade-insert 10.

When the lever 52 is depressed in the direction of arrow 76, a fulcrum 78 of the lever 54 applies a mechanical advantage to the top of the first modified frame member 58 sufficient to urge it toward the second modified frame member 62.

The pin 54 prevents the second modified frame member 62 from moving away from first modified frame member 58 as the lever 52 is depressed. This causes the second modified blade 74 and the first modified blade 70 to move toward each other until the cutting edge 36 and the second cutting edge 36*a* align with each other and any finger nail 324 or toe nail placed there-between has been severed.

The second disposable type of a nail clipper with blade-insert 50 shares the advantages of being lightweight, inexpensive to manufacture, low cost of purchase, space for the advertisement 46, and because of little metal, freedom from detection by airport security devices of the first disposable type of a nail clipper with blade-insert 10.

If desired, a retainer clip 79 can be inserted over the opposite rear 68 of the first modified frame member 58, the wedge 64, and the second modified frame member 62 to secure them together. The retainer clip 79 if formed of metal or any preferred material and can be crimped in place to provide a low-cost manufacturing method.

Referring now primarily to FIG. 3 is shown a portion of a first half of a third disposable type of a nail clipper with blade-insert, identified in general by the reference numeral 100.

A front portion 102*a* of a second modified frame member 102 is shown. The second modified frame member 102 and those portions of the third disposable type of a nail clipper with blade-insert 100 not shown or otherwise described as being different than the previously described embodiments, are substantially the same as with either the first disposable type of a nail clipper with blade-insert 10 or, alternately, the second disposable type of a nail clipper with blade-insert 50.

The front portion 102*a* includes a horizontal recess 104 into which a third modified blade 106 is disposed and attached in any preferred manner. For all embodiments described hereinafter, the cutting edge 36 is similarly included. Also, for all embodiments described hereinafter, a bottom half that is not shown includes a mirror image of the top portion which is shown and described. The cutting edge 36 will similarly align with the second cutting edge 36*a* (of the bottom half) when the bottom half is urged toward the top half (i.e., for example, toward the second modified frame member 102) that is shown.

The third disposable type of a nail clipper with blade-insert 100 provides the advantages of the previously described embodiments.

Referring now primarily to FIG. 4 is shown a portion of a first half of a first replaceable blade type of a nail clipper with blade-insert, identified in general by the reference numeral 150.

A replacement blade assembly, identified in general by the reference numeral 152 is shown in a spaced-apart orientation, ready for insertion into an open end 154 of a third modified frame member 156.

The replacement blade assembly 152 is similar to the front portion 102*a* of the third disposable type of a nail clipper with blade-insert 100. However, the replacement blade assembly 152 is detachably-attachable with respect to the third modified frame member 156.

A pair of tangs 158, 160 extend from the replacement blade assembly 152 and each include a respective beveled leading edge 162, 164. Each leading edge 162, 164 will extend progressively further away from a center of the replacement blade assembly 152 as it passes toward the third modified blade 106 until it terminates at a retaining edge 166, 168 that are each perpendicular with respect to arrow 170.

The replacement blade assemblies 152 are expected to be sold in pairs for replacement of a prior set when the cutting edges 36, 36*a* of the first replaceable blade type of a nail clipper with blade-insert 150 become dull.

To remove a previously used and now dull replacement blade assembly 152 from the third modified frame member 156 (or bottom member; not shown), a force is simultaneously applied through a pair of side openings 172, 174 that are provided in the third modified frame member 156 to the two leading edges 162, 164.

The two leading edges 162, 164 are urged toward each other an amount sufficient to permit the retaining edges 166, 168 to clear the side openings 172, 174. The pair of tangs 158, 160 bend inward in response to the force that is applied.

A force in the opposite direction of arrow 170 is also simultaneously applied to the replacement blade assembly 152 while the leading edges 162, 164 are depressed. When the retaining edges 166, 168 clear the side openings 172, 174, the replacement blade assembly 152 is pulled out of the open end 154 of the third modified frame member 156.

This is repeated for both the first (top) half of the first replaceable blade type of a nail clipper with blade-insert 150 and also for the second (bottom) half (not shown).

To insert a new replacement blade assembly 152 after an older one has been removed, it is simply oriented as shown in the drawing and urged in the direction of arrow 170 until a click is heard as the retaining edges 166, 168 pass beyond the front edge of each of the side openings 172, 174. The replacement blade assembly 152 is accordingly held in position. Furthermore, the cutting edge 36 of the top replacement blade assembly 152 is aligned with the second cutting edge 36*a* (not shown) of the bottom replacement blade assembly 152.

An additional benefit is provided over the previous embodiments described herein. The additional benefit is that the first replaceable blade type of a nail clipper with blade-insert 150 can be restored to like-new cutting ability by periodically replacing the replacement blade assemblies 152. The replacement blade assemblies 152 are a consumable item, similar to razor blades, which can prove to be as profitable or potentially even more profitable than the sale of the first replaceable blade type of a nail clipper with blade-insert 150.

Referring now primarily to FIG. 5 and also to FIG. 6 is shown a portion of a first half of a second replaceable blade type of a nail clipper with blade-insert, identified in general by the reference numeral 200.

A second replacement blade assembly 202 includes a modified blade 204 that is attached to a channel member 206. The modified blade 204 and the channel member 206 are preferably formed of steel. The channel member 206 in cross-section (FIG. 6) includes a generally rectangular "C-shape" that is adapted to slide over an end 208 of a fourth modified frame member 210.

The second replacement blade assembly 202 includes an alignment hole 212. The fourth modified frame member 210 includes an alignment protrusion 214 that engages with the alignment hole 212 when the second replacement blade assembly 202 is fully inserted onto an end of the fourth modified frame member 210.

The alignment protrusion 214 disposed in the alignment hole 212 provides two benefits. Together, they ensure that the second replacement blade assembly 202 is fully and properly inserted on the fourth modified frame member 210 and they help retain the second replacement blade assembly 202 in position.

To ensure that the second replacement blade assembly 202 is not inserted too far onto the fourth modified frame member 210, an elevated ridge 216 is preferably included as part of the fourth modified frame member 210 that prevents over-insertion of the second replacement blade assembly 202.

To remove the second replacement blade assembly 202 from the fourth modified frame member 210 it is grasped and sufficient force is applied in the direction of arrow 218 while retaining the remainder of the second replaceable blade type of a nail clipper with blade-insert 200. The resistance provided by the alignment protrusion 214 in the alignment hole 212 is overcome and the second replacement blade assembly 202 is separated apart from the fourth modified frame member 210.

To add a new second replacement blade assembly 202 it is urged in a direction opposite that of arrow 218 until the alignment protrusion 214 is in the alignment hole 212 and a rear edge of the second replacement blade assembly 202 is disposed against the elevated ridge 216.

Of course, when replacement is warranted, two of the second replacement blade assemblies 202 are used at both the top and bottom halves of the second replaceable blade type of a nail clipper with blade-insert 200.

For example, referring now primarily to FIG. 7 is shown, a fourth disposable type of a nail clipper with blade-insert, identified in general by the reference numeral 250.

The fourth disposable type of a nail clipper with blade-insert 250 is similar to the first disposable type of a nail clipper with blade-insert 10. However, the fourth disposable type of a nail clipper with blade-insert 250 includes a raised pivot area 252 in a bottom half 254 of a further modified frame member 256. The further modified frame member 256 is preferably formed of plastic or nylon (not metal).

The raised pivot area 252 extends across the width of the bottom half 254. A modified lever 258 is preferably formed of a plastic or nylon and pivots about a bottom pivot pin 260. The bottom pivot pin 260 passes through the raised pivot area 252 and also through a bottom end of a pair of opposite lower sides 262 of the modified lever 258. The modified lever 258 is similar in design to that which was disclosed in the above-referenced pending patent application.

If desired, the bottom pivot pin 260 can be eliminated and a pair of modified bottom pivot pins (not shown) can instead be provided. The modified bottom pivot pins are each molded as a cylindrical extension to each of the pair of opposite lower sides 262 proximate the bottom thereof and extending inward a predetermined distance toward each other. A corresponding cylindrical opening is provided on each side of the raised pivot area 252 to receive one of the pair of modified bottom pivot pins.

This can help to lower manufacturing and assembly cost. To assemble the fourth disposable type of a nail clipper with blade-insert 250 when the pair of modified bottom pivot pins are used, the pair of opposite lower sides 262 are urged apart an amount sufficient to permit each of the modified bottom pivot pins to enter into the corresponding cylindrical openings in the raised pivot area 252, where they are urged inward by their own elastomeric properties. The modified bottom pivot pins then snap into the cylindrical openings where they are retained.

The pair of opposite lower sides 262 (the rear side is not visible) are disposed on opposite sides of the further modified frame member 256. The modified lever 258 includes an opening (as indicated by bracket 263) that extends from the bottom pivot pin 260 (i.e., the bottom of the modified lever 258) up to an upper cross member 264. The opening extends along the length of the opposite lower sides 262 as shown by bracket 263.

The upper cross member 264 extends across the width of the modified lever 258 and when the modified lever 258 is urged in the direction shown by arrow 266, the modified lever 258 bears against and urges an upper half 268 of the further modified frame member 256 toward the bottom half 254. The cutting blade 34 and the second cutting blade 34*a* are then drawn together sufficient to sever a toe nail or a finger nail 324.

The upper cross member 264 can extend up to and into a finger pad 270 or, if preferred, it can extend only partially along the remaining length of the modified lever 258. For storage, the modified lever 258 is pivoted about the bottom pivot pin 260 in the direction of arrow 272 until it is disposed under the bottom half 254 and is adjacent thereto.

The only metal used in the fourth disposable type of a nail clipper with blade-insert 250 are for the cutting blade 34 and the second cutting blade 34*a* and the bottom pivot pin 260. Of course, the bottom pivot pin 260 could be made of a material other than metal, if preferred. Also, if the modified bottom pivot pins are used instead of the bottom pivot pin 260, they would not be formed of metal.

Accordingly, the fourth disposable type of a nail clipper with blade-insert 250 includes all of the advantages of the first disposable type of a nail clipper with blade-insert 10 plus the added ease of use that is provided by the mechanical advantage created by the modified lever 258.

As disclosed, the fourth disposable type of a nail clipper with blade-insert 250 is expected to be used for a period of time and then disposed of. Depending on the quality of construction, the period of time can be less than, equal to, or even longer than that of the known prior-art types of nail clippers.

However, if preferred, it can be further modified so that it includes either the replacement blade assembly 152 or the second replacement blade assembly 202, or any other possible type of modified replacement blade assembly (not shown).

After having had benefit of the instant disclosure, it is anticipated that other and further modifications will be obvious to those possessing ordinary skill.

For example, the first enlarged front portion 22 of the first disposable type of a nail clipper with blade-insert 10, the second disposable type of a nail clipper with blade-insert 50, the third disposable type of a nail clipper with blade-insert 100, or the fourth disposable type of a nail clipper with blade-insert 250 could each be modified, as desired, so as not to be disposable but to include a preferred type of replacement blade assembly 152, 202 (or newly designed).

For example, any of the disposable types of a nail clipper with blade-insert 10, 50, 100, 250 can be modified to include the teachings of the first replaceable blade type of a nail clipper with blade-insert 150 (FIG. 4) including a modified replacement blade assembly (not shown).

The modified replacement blade assembly would be similar to the replacement blade assembly 152 except that the cutting blade 34 and the second cutting blade 34*a* of the modified replacement blade assembly would be attached vertically (as shown in FIG. 1 or FIG. 7) instead of horizontally, as shown in FIG. 4. This is to illustrate only a small sampling of the many modifications that are now possible regarding the replacement blade assemblies 152, 202.

Similarly, any disposable type of a nail clipper with blade-insert 10, 50, 100, 250 can be modified to include the second replaceable blade type of a nail clipper with blade-insert 200.

Also, any of the versions herein can include any type of an enclosure (not shown) to retain the nail clippings.

An additional modification could allow replacement of only the cutting blade 34 instead of the replacement blade assembly 152 (or the second replacement blade assembly 202) which include additional components other than the cutting blade 34.

For example, the first recess 30 could be modified to secure the cutting blade 34 in position, allow its withdrawal, and permit the insertion of a replacement cutting blade 34 therein.

As an example of a possible way to secure the cutting blade 34 in a modified type of a first recess (not shown), a modified type of a cutting blade (not shown) could include an opening into which a protrusion that is provided in the modified type of a first recess would engage, similar to way in which the alignment hole 212 and the alignment protrusion 214 cooperate.

The modified type of a cutting blade is grasped and pulled out and another is urged into the modified type of a first recess. This is generally not preferred over use of the replacement blade assemblies 152, 202 because of the possibility of injury occurring during removal or insertion of the modified type of a cutting blade into the modified type of a first recess.

Referring now to FIG. 8, for any version of the nail clipper with blade-insert 10, 50, 100, 150, 200, 250 (including the blades 300 and 301, described in greater detail hereinafter) the cutting blade 34 and the second cutting blade 34*a* require that the cutting edges 36, 36*a* contact each other when the device is urged into a closed position. The planar portion of each cutting blade 34, 34*a* does not have to be vertical or in parallel planar alignment with each other but could be disposed at an angle, if preferred.

If desired, the cutting blades 34, 34*a* could be formed of a material other than metal, for example, a ceramic material.

Other changes are also possible. As is well-known in the nail clipper arts, a radius is included in the cutting edges to provide a curvature to the nails (either toe or finger) when cut. Prior art designs machine the curvature into the cutting edges. However, with any version of the instant invention, the cutting blades 34, 34*a* can be formed of a flat material stock, if preferred, that is bent to provide the desired amount of curvature during assembly. This provides even lower cost for the manufacture of the cutting blades 34, 34*a*.

If preferred, any portion of any version of the instant invention as described herein that is formed of a plastic, nylon, or polymer, for example, can include either a solid core or a hollow core. Proper selection of materials and skillful design will, of course, allow minimal use of the plastic, nylon, or polymer. Not only does minimal use reduce manufacturing cost, it also reduces weight, which in turn, can substantially reduce shipping costs. This is especially true when compared with the known prior-art. Also, a lower weight makes portage of the instant invention easier to accomplish, whether it is placed in a pocket, purse, or added to a keychain, for example.

Referring to FIGS. 9, 10, and 11 a modified blade 300 is shown that is similar to that shown in FIG. 5 and FIG. 6. As shown in FIG. 9 the modified blade 300 is flat. It has been stamped from low cost flat steel stock. The modified blade 300 includes a cutting edge 302 that has been provided (machined or ground) in the flat steel stock at an end of a blade extension portion 304.

The cutting edge 302 for any embodiment of the invention can include, as desired, a "V-shape" as shown in FIG. 10 and FIG. 11 or it can be tapered from one edge only as shown for the cutting edge 36 and the second cutting edge 36*a* of FIG. 1, FIG. 2, FIG. 3, FIG. 4, FIG. 5, FIG. 7, and FIG. 8. Similarly, any cutting edge 302, 36, 36*a* can be straight or curved, as desired. If a curvature is desired, it is preferably introduced during machine forming (i.e., machining) of any desired type of the blade 34, 34*a*, 106, 204, 300, (and 301, as described below).

Dashed lines 306, 308, 310, and 312 indicate lines about which the modified blade 300 is bent quickly and inexpensively by machine to fit around an end of a plastic modified member 314. The modified blade 300 is bent downward (with respect to FIG. 9) along dashed lines 306, 308, 310, and 312 to surround the modified member 314 and secure the modified blade 300 thereto.

The blade extension portion 304 is bent upward, with respect to the view that is shown in FIG. 9, along dashed line 316 to provide a finished shape to the modified blade 300 as shown in FIG. 10.

If desired, the blade extension portion 304 is lengthened to provide a lengthened blade extension portion 305. The lengthened blade extension portion 305 is bent downward, with respect to the view that is shown in FIG. 9, to provide a further modified blade 301, as shown in FIG. 11 for attachment to a standard plastic member 318.

The standard plastic member 318 is similar to the member shown in FIG. 5 in that no portion of the plastic member 318 protrudes beyond the cutting edge 302 of the further modified blade 301.

In FIG. 10, the modified member 314 includes a protrusion 320 that extends forward of the cutting edge 302 of the blade extension portion 304. The protrusion 320 creates a safety bumper that prevents injury to the user and which determines the cut length of a nail 324, as explained in greater detail hereinafter. The protrusion 320 can include any desired length forward of the blade extension portion 304 and it can include any desired shape or profile. See FIGS. 1, 2, 7, and 8 which show the protrusion 320 on the top and bottom portions of each embodiment that is shown. See also FIGS. 12, 14, 15, 16, and 17.

Referring again to FIG. 10, a fleshy part of a tip of a finger 322 contacts the protrusion 320 and limits how far the nail 324 can be inserted under the cutting edge 302. The distance from the cutting edge 302 to the tip of the protrusion 320 is shown by arrow 326. This, in turn, limits the amount of material that can be removed from the nail 324. Therefore, a means is provided for controlling a depth of cut of the nail 324. By varying the length of the protrusion 320 the means for controlling a depth of cut of the nail 324 is able to provide any desired depth of cut of the nail 324.

A slight inward concavity 328 of the fleshy portion of the tip of the finger 322 is shown in FIG. 10. The inward concavity 328 occurs in response to the force applied by the user tending to urge the finger 322 toward the cutting edge 302. The amount of inward concavity 328 varies only slightly over a reasonably wide range of forces that the user may apply. However, from a practical point of view the user will not apply so much force that it feels uncomfortable. Rather, the user will tend to apply a force that is nearly the same for all fingers 322, which will result in a uniform depth of cut for all fingers.

By limiting the amount the nail 324 can be inserted into any version of the nail clipper with blade-insert 10, 50, 100, 150, 200, 250 the protrusion 320 extending beyond the cutting edge 302 (or 36, 36*a*) provides the safety bumper that controls the depth of cut of the nail 324 and significantly reduces the risk of over-inserting the nail 324 and cutting any of the fleshy part of the finger 322 in the process. The protrusion 320, which extends forward of the cutting edge 302, is the safety bumper which prevents over-insertion of the nail 324 and it also prevents accidental cutting of the fleshy part of the finger 322.

Accordingly, the safety bumper is provided which increases safety when using a type of nail clipper that includes parallel opposed blades that are urged together and abut each other when fully closed. This permits use by visually impaired people and by those with other disabilities that otherwise would be unable to cut their own nails 324.

If is, of course, understood that FIG. 10 and FIG. 11 only show a portion of one side of a desired nail clipper and that the remaining opposite side that is not shown would be a mirror image of the side that is shown and that both sides would be attached together at a distal end, thereof, (i.e., to the right of the modified member 314 of FIG. 10 and to the right of the standard plastic member 318 of FIG. 11) or formed of a continuous piece. The cutting edge 302 of the remaining opposite side that is not shown is always parallel with respect to the cutting edge 302 that is shown and the two cutting edges would align and abut each other without overlap during use when they were urged together.

Referring to original drawing FIGS. 1, 2, 7, and 8 the protrusions 320 of each FIG. have a different length which, accordingly, provides for a different depth of cut (i.e., length of the cut nail). The protrusions 320 can also have any desired shape. Therefore, the protrusions 320 as shown in FIGS. 1, 2, 7, 8, 10,12, 14, 15, 16, & 17 indicate some of the shapes and design configurations that are possible. Other shapes for the protrusion 320 are also anticipated.

Referring now first to FIG. 2, the protrusions 320 of the second disposable type of a nail clipper with blade-insert 50 include the smallest distance of any shown from the cutting edge 36 or from the second cutting edge 36*a* (which is the equivalent of the cutting edge 302 of FIG. 10) to the tip of the protrusion 320 (comparable with that shown by arrow 326 of FIG. 10, though not equivalent in actual magnitude). The shortest possible distance from the tip of the protrusion 320 to the cutting edge 36 provides a maximum amount of depth of cut of the nail 324 while still providing some limitation as to how far the nail 324 can be inserted beyond the first and second cutting edges 36, 36*a*. This reduces the risk of injury (of cuts) while still providing the shortest possible nail 324 length after cutting.

Referring next to FIG. 1, the protrusions 320 of the first disposable type of a nail clipper with blade-insert 10 include a slightly greater distance from the cutting edge 36 (or from the second cutting edge 36*a*) to the tip of the protrusion 320 than that of the second disposable type of a nail clipper with blade-insert 50. By providing a slightly greater distance from the tip of the protrusion 320 to the cutting edge 36, the first disposable type of a nail clipper with blade-insert 10 provides a slightly reduced magnitude for the depth of cut of the nail 324 by slightly further limiting the amount that the nail 324 can be inserted beyond the first and second cutting edges 36, 36*a*. This results in a slightly longer finished nail 324 length after cutting while further reducing the risk of cutting any of the flesh.

Referring next to FIG. 7, the protrusions 320 of the fourth disposable type of a nail clipper with blade-insert 250 include a second greater distance from the cutting edge 36 (or from the second cutting edge 36*a*) to the tip of the protrusion 320 than that of the first or second disposable type of a nail clipper with blade-insert 10, 50. By providing a slightly greater distance from the tip of the protrusion 320 to the cutting edge 36, the fourth disposable type of a nail clipper with blade-insert 250 provides a second even further reduced magnitude for the depth of cut of the nail 324 that that provided by the first or second disposable type of a nail clipper with blade-insert 10, 50. This, in turn, provides an even greater second increased limitation as to how far the nail 324 can be inserted beyond the first and second cutting edges 36, 36*a*. This results in an even longer finished nail 324 length after cutting and added safety. If it is sufficiently long and can leave some of the naturally occurring white portion of certain people's finger nails it would be capable of providing a "natural" type of French manicure cut to the nail 324.

Referring now to FIG. 8, which can be used with any version of the nail clipper with blade-insert 10, 50, 100, 150, 200, 250, 400, 500 including use of the blades 300 and 301 the distance from protrusions 320 as shown in FIG. 8 to the cutting edges 36, 36*a* is the greatest of any as shown in FIG. 1, 2, 7, or 8. Therefore, an even greater distance from the tip of the protrusion 320 to the cutting edge 36 (or to the second cutting edge 36*a*) provides a still further reduced magnitude for the depth of cut of the nail 324 which results in an even longer finished length of the nail 324 after cutting. This can provide even greater safety and length for the natural French manicure cut to the nail 324.

Any style or version of the nail clipper with blade-insert 10, 50, 100, 150, 200, 250, 400, 500 can be provided with any length for the protrusion 320. It is anticipated that most users will select a preferred version with a preferred length of the protrusion 320. It is also anticipated that a plurality of any style or version of the nail clipper 10, 50, 100, 150, 200, 250, 400, 500 will be provided with progressively increasing lengths for the protrusion 320 and marketed individually and as a set. This permits individuals who purchase the set to cut their own nails to any desired length. They can even give themselves a natural French manicure. Manicurists are also expected to purchase the set to more easily provide consistent nail length or French manicures for their customers.

Referring again momentarily to FIG. 10 a series of Braille markings 330 are included as surface irregularities provided on the modified member 314. The Braille markings 330 can be used to identify the depth of cut (which is inversely proportional to the length of the protrusion 320) or to provide any other desired information, such as the nail clipper's 10, 50, 100, 150, 200, 250, 400, 500 color.

The safety bumper (i.e., the protrusion 320) controls the depth of cut. Accordingly, the instant invention provides the only known type of nail clipper that includes means for positively controlling (i.e., limiting) the depth of cut possible for the nail 324. The instant invention, thereby, provides the only known type of nail clipper that positively controls and limits the amount of material that can be cut (i.e., removed) from a nail and in this way it determines how long the finished nail will be after it has been cut.

It is important to note that the maximum permissible depth of cut (the amount of material that is removed from the nail 324) is relative to the tip of the finger 322 of the user. That means that after the nail 324 has been cut, even if the user attempts to again cut the same nail 324 using the same nail clipper (any embodiment thereof that includes the safety bumper [i.e., the protrusion 320]), then a repeated attempt at cutting the nail 324 will not remove anymore additional material because the nail clipper will be blocked (i.e., prevented) from being urged closer toward the nail 324 by the tip of the finger 322. Accordingly, additional material cannot be removed (i.e., cut) from the nail 324 even if the user makes additional attempts to do so.

As briefly noted, there will typically be little variation in the finished length of the nail 324 after cutting between different users who use the same length safety bumper (i.e., protrusion 320). This is because the depth of the fleshy portion extending over the bone at the tip of most fingers 322 does not vary significantly between most people. Also, as previously mentioned, the user will not apply so much force as to feel discomfort in contacting the protrusion 320. If each user applies a consistent force when cutting their nails 324, then all of their nails 324 will be of nearly the same length after cutting.

If one user were to consistently apply a greater force than does another user apply when using any embodiment of the disclosed nail clipper with safety bumper, and if the greater force results in creating a consistently deeper inward concavity 328, then for any given finished length of nail 324 that is desired the one user who applies the greater force would purchase and use a version of the instant nail clipper that included a longer protrusion 320 (i.e., a longer safety bumper) than would the other user to obtain an equivalent finished length of nail 324 after cutting relative to the tip of the finger 322 of each user.

It is desirable to include a visible indication 332 of the length (326) of the protrusion 320. The visible indication 332 can provide in millimeters or other units an expected finished (i.e., cut) length for the nail 324 or it can be used to indicate the length of the naturally occurring white portion of the nail 324. Preferably, the visible indication 332 is provided in the plastic modified member 314 or in any plastic member of any version of the nail clipper 10, 50, 100, 150, 200, 250, 400, 500 318 during manufacture. All preferred versions of the invention include plastic member(s) or nylon or polymer member (s) for supporting the (metal or ceramic) blades and most designs can be modified to include the safety bumper (protrusion 320). Raised molded or printed text indicates the expected length of the finished nail 324 after it has been cut.

The finished length of the nail 324 would preferably include an average length of the nail 324 taken from a sampling of users indicating what most users will obtain for any given length of protrusion 320 (i.e., for any given length of the safety bumper). This provides an excellent starting point for the user to select and purchase a desired version of the instant nail clipper that includes the safety bumper.

If, however, the user tends to be especially light in applying force then the user may need a version of the nail clipper having a shorter protrusion 320 than average. As mentioned above, if the user tends to be especially heavy in applying force then the user may need a version of the nail clipper having a longer protrusion 320 than average.

There are many possible ways of providing the visual indication 332. If desired, the visible indication 332 can include a color-coding scheme whereby a particular color or pattern of colors for the plastic member(s) or for a portion of the plastic member(s) of any desired version of the instant invention is indicative of the length of the protrusion 320 (or any other desired information).

If the visual indication 332 includes raised markings of any sort, then the visual indication 332 would also provide a tactile indication of the length of the protrusion 320 (or other information). It is to be understood that the length of the protrusion 320 is directly proportional to and thereby indicative of the cut length of the nail 324.

By including Braille markings in the plastic modified member 314 or in the standard plastic member 318 (or in the plastic member(s) of any version) when they are formed or molded), the instant invention provides the only known type of nail clipper that controls the amount of material that can be cut (i.e., removed) from a nail 324 (i.e., how long the cut nail 324 will be) and which is able to inform the blind or visually impaired person what the expected finished length of the nail 324 will be before use of any version of the nail clipper that includes the safety bumper. This allows the blind or visually impaired to more precisely groom their nails 324 to a particular standard of length and to do so without assistance.

Referring now to FIG. 12, a forward projecting blade 350 is shown embedded in the forward end of a plastic member 352. Only a portion of the plastic member 352 is shown. It is understood that a curved cutting edge 354 of the projecting blade 350 will abut a mirror-image of the structures that are shown in the actual completed nail clipper. If preferred, a straight cutting edge 302, 36, 36*a* could be used instead of the curved cutting edge 354. The protrusion 320 extends forward of the projecting blade 350 to prevent over-insertion of the tip of the finger 322 (for safety) and to control the finished length of the cut nail 324.

Referring briefly to FIG. 13, an embedded blade 360 includes the straight cutting edge 302. The embedded blade 360 extends out of the forward end of a square-end plastic member 362. Accordingly, the cutting edge 302 would be disposed forward of any portion of the nail clipper that is completed by extending the square-end plastic member 362 to the rear and including a mirror image underneath. This version would not provide a safety bumper because it would not include the protrusion 320.

FIG. 14, illustrates a way to include the safety bumper by a slight modification made to the structure of FIG. 13. A modified protrusion 370 extends forward of the cutting edge 302 and therefore, provides the safety bumper. As previously described herein for other possible embodiments, by controlling the distance that the modified protrusion 370 extends in front of the cutting edge 302, the length of the finished nail 324 can similarly be controlled.

By providing an additional quantity of plastic in the modified protrusion 370 that extends downward and which contacts the upper surface of the embedded blade 360 across its width, additional reinforcement is provided that improves strength and rigidity of the embedded blade 360. Accordingly, the resultant safety bumper that is provided by the modified protrusion 370 also provides an unexpected additional benefit of strengthening the embedded blade 360. This helps to prevent flexing and possible loosening of the embedded blade 360 during use, especially when cutting very thick or hard nails 324.

This illustrates how by modifying the shape of the protrusion 320, it is possible to provide the safety bumper as well as additional reinforcement for the embedded blade 360. Additional modification continuing these teachings will allow for inclusion of the safety bumper and a method for controlling the length of the cut nail 324 for use with the blades 34, 34*a*, 300, 350, 360 in any version of the nail clipper 10, 50, 100, 150, 200, 250, 400, 500. If the blade itself blocks forward extension of the plastic member (See FIG. 5 and FIG. 11) the protrusion 320 or the modified protrusion 370 can be included by extending the plastic forward around the sides of the modified blade 204, 301 or over the top of the blades.

Referring momentarily to FIG. 3, the top of the front portion 102*a* of the second modified frame member 102 can be extended forward to pass a predetermined desired distance forward of the plane of the third modified blade 106 and forward of the cutting edge 36 to provide a further modified type of a protrusion (not shown) and, therefore, to provide the safety bumper.

Referring momentarily to FIG. 4, the plastic surrounding the third modified blade 106 can similarly be extended forward, as desired, to provide the further modified type of the protrusion and safety bumper for the replacement blade assembly 152.

Referring now to FIG. 15, is shown a further modified nail clipper identified in general by the reference numeral 400 that is somewhat similar to that as previously shown and described in FIG. 2. The further modified nail clipper 400 includes a pair of upper and lower plastic members 402, 404 that are each attached together along a rear portion, identified by bracket 400*a*. The rear portions 400*a* are joined together by fusion (heat, ultrasound, etc.), adhesive, or mechanical fastener, as desired.

A small angle 406 is preferably included between the plane of a main body 400*b* and the plane of the rear portion 400*a* of at least one and preferably both the plastic members 402, 404 to introduce an offset that, when fastened together supplies a force sufficient to urge the modified blades 300 apart when they are not, otherwise, being urged toward each other.

The use of the modified blades 300 illustrates how the modified protrusion 370 can be varied slightly and used to create the safety bumper, limit the depth of cut of the nail 324, and provide additional structural support for different types of blades.

An unexpected and significant improvement in the manufacture of the further modified nail clipper 400 (as well as any version that includes separate upper and lower members) is provided by these structures. By separately manufacturing the plastic members 402, 404 and providing the modified blades 300 in a flat orientation (FIG. 9), the modified blades 300 can be quickly bent by machine to fit around the plastic members 402, 404 and abut the portion of the modified protrusion 370 that provides additional support to the blade extension portion 304.

Because it is important to ensure proper alignment of the cutting edges 302 in the finished device, after the modified blades 300 have been attached to each of the pair of plastic members 402, 404, the plastic members 402, 404 are then properly oriented with respect to each other so as to ensure that the cutting edges 302 align. This may cause a slight forward or rearward displacement and offset to occur between the two rear portions 400*a*. The two rear portions 400*a* are then fused (or otherwise attached) together. This ensures proper alignment of the cutting edges 302.

After attachment, if desired, a distal end of the rear portions 400*a* can be trimmed to provide a flush, or more even appearance. If desired, the retainer clip 79 or a modification thereof can be placed over the rear portions 400*a* to secure the plastic members 402, 404 together or as a covering over the rear portions 400*a* to improve the aesthetics of the further modified nail clipper 400.

For any version of the nail clipper 10, 50, 100, 150, 200, 250, 400, 500 (see below), if desired, a pair of opposing inner bumpers 408, 410 (shown in dashed lines to indicate their optional inclusion) can be added. The inner bumpers 408, 410 can be molded into the plastic members 402, 404 or attached, for example, by an adhesive. The inner bumpers 408, 410 include a combined height that causes them to come in contact with one-another at approximately the same time that the two opposing cutting edges 302 come in contact with each other. The inner bumpers 408, 410 can be set to contact each other slightly before or slightly after the cutting edges 302 contact one-another.

It is generally preferred that the inner bumpers 408, 410 each include the same height. This would continue to allow the plastic members 402, 404 to be manufactured as an identical assembly which would reduce manufacturing parts inventory and the overall cost of manufacturing. If desired, one of the inner bumpers 408, 410 could be made so that it was longer than the other providing the combined length of the two different height inner bumpers 408, 410 resulted in contact at about the same time that the cutting edges 302 contacted each other. If desired, only one of the inner bumpers (either 408 or 410) could be included and the other omitted providing the length for one inner bumper (either 408 or 410) was equal to the combined overall length of both of the inner bumpers 408, 410.

The inner bumpers 408, 410 provide a limit or "stop" that limits or prevents a further urging of the plastic members 402, 408 toward each other. This prevents the user from inadvertently possibly applying an excessive amount of force to the lever 52 after the cutting edges 302 have come into contact with each other.

Absent the inner bumpers 408, 410, if an excessive amount of force was applied to the lever 52 when the cutting edges 302 were abutting, the inner fulcrum 78 would continue to displace the plastic members 402, 404 closer toward each other. The abutting cutting edges 302 cannot move closer together. Therefore, a portion of the plastic member 402 that is disposed underneath the fulcrum 78 and a portion of the opposite plastic member 404 proximate a bottom end 412*a* of a modified pin 412 would begin to distort as they were urged closer toward each other. This would subject the plastic members 402, 404 to excessive strain and to possible breakage. The extra pressure could also dull or otherwise damage the cutting edges 302 and, if severe-enough, the distortion could offset the cutting edges 302 and cause an overlap of the cutting edges 302 to occur. The inner bumpers 408, 410 prevent these adverse conditions from occurring.

If desired, for any embodiment the plastic members 402, 404 could, of course, be formed (molded) as a single piece (See FIG. 1, FIG. 7, and FIG. 16.) Also, if desired, any preferred type of elastomer could be included to provide a force to urge the opposing blades 34, 34*a* apart. For example, an oval shaped elastomer could be inserted and retained in an opening that is provided proximate a rear of any version of the instant invention.

Referring now to FIG. 16 and also to FIG. 17 is shown a hinged nail clipper 500 that includes a left member 502 and a right member 504 that are formed of a plastic and which are connected by a flexible plastic hinge 506. The left and right members 502, 504 and the hinge 506 are formed together by injection molding or by any other preferred method. The right member 504 is shown as including the blade 34 embedded in an end thereof and the left member 502 is shown as including the second blade 34*a* embedded in an end thereof, although any of the blades 106, 204, 300, 301 could be used.

The right member 504 includes a securing and aligning pin 508 that extends upward. The left member 502 includes a pin opening 510 for receiving the securing and aligning pin 508.

After molding and attachment of the blades 34, 34*a* the right member 504 is rotated in the direction of arrow 512. When the securing and aligning pin 508 enters the pin opening 510 additional force is applied to urge it fully therein. Friction is used to maintain the securing and aligning pin 508 in the pin opening 510. Alternately, an enlarged tip 508*a* is provided at the end of the securing and aligning pin 508 and a correspondingly-shaped enlarged opening 510*a* is provided at the bottom of the pin opening 510 to provide a mechanical latch that retains the securing and aligning pin 508 in the pin opening 510.

If desired, a preferred type of lever (similar to the lever 52) and a preferred type of pin (similar to the pin 54) can also be added to the hinged nail clipper 500. FIG. 17 shows the hinged nail clipper 500 in an assembled and ready-to-use condition after the right member 504 has been fully urged in the direction of arrow 512. By molding the left and right members 502, 504 and the hinge 506 as a one-piece assembly the cost of manufacturing can be reduced. The use of the hinge 506 facilitates rotation and final assembly, thereby further lowering the cost of manufacture.

As mentioned, any preferred or desired type of plastic can be used including clear (transparent or semi-transparent) types of plastic as well as scented or other types of plastic, as desired.

It is understood that any of the embodiments disclosed herein including the modifications or variations made thereto can, of course, be further modified to produce additional variations or embodiments not necessarily disclosed herein but which would fall under the design purview of those possessing ordinary skill in the art after having had benefit of the instant disclosure in order to provide a desired combination of attributes, features and benefits.

For example, the modified blades 300 can be used with the first disposable type of a nail clipper with blade-insert 10 of FIG. 1 or with the fourth disposable type of a nail clipper with blade-insert 250 of FIG. 7 if the one-piece plastic frame member 12 (or if the modified frame member 256) is desired as the interconnecting body that supports the modified blades 300.

It is useful to summarize what occurs during use of any version or possible embodiment of the nail clipper 10, 50, 100, 150, 200, 250, 400, 500. This helps to differentiate the instant invention from other types of nail clippers (not shown) and to better illustrate the benefits that are provided. Every version of the nail clipper 10, 50, 100, 150, 200, 250, 400, 500 severs a portion of a nail 324 that is disposed between the cutting edges 36, 36*a*, 302 in an identical way when the opposing blades 34, 34*a*, 300, 301 are progressively urged toward each other.

To expand upon what was described earlier, the simultaneous cutting of the nail 324 that occurs on both sides of the nail 324 begins after the opposing cutting edges 36, 36*a*, 302 have made their initial contact with opposite sides of the nail 324. As the cutting edges 36, 36*a*, 302 are drawn closer together a first cut begins to develop along an upper surface or upper side of the nail 324. Simultaneously, a second cut begins to form along an opposite lower surface or lower side of the nail 324. The first cut and the second cut are in alignment with respect to each other and are simultaneously forming on opposite sides of the nail 324.

As the blades 34, 34*a*, 300, 301 are progressively urged closer together the depth of the first cut and of the second cut continue to deepen progressively further into the nail 324. This is occurring simultaneously for both the first cut and the second cut. The width of the first cut and the width of the second cut cannot exceed the width of the cutting edge 36, 36*a*, 302. However, if the width of the nail 324 is only slightly greater than the width of the cutting edge 36, 36*a*, 302 the portion of the nail 324 that is to be removed may be completely severed from the remainder of the nail 324 even though the width of the cutting edge 36, 36*a*, 302 is less than the width of the portion that is being removed.

This is because the cutting edges 36, 36*a*, 302 include a thickness dimension that is preferably kept as small as possible. Therefore, as the cutting edges 36, 36*a*, 302 enter into the nail 324 a force is applied by the cutting edges 36, 36*a*, 302 to the nail 324 that is tending to urge the portion that is being removed away from the remainder of the nail 324. This force may be sufficient to sever the portion that is being removed even if it includes a width that slightly exceeds the width of the cutting edges 36, 36*a*, 302. If it is not sufficient, then the process (cycle) is repeated by carefully positioning the nail clipper 10, 50, 100, 150, 200, 250, 400, 500 before making an additional upper cut and an additional lower cut to ensure that the cutting edges 36, 36*a*, 302 align with and thereby extend the first cut and the second cut a sufficient amount to fully sever the portion that is being removed from the nail 324.

The width of the first cut and of the second cut can also be limited by the width of the portion of the nail 324 that is disposed between the cutting edges 36, 36*a*, 302. If only a small portion of the nail 324 is disposed between the cutting edges 36, 36*a*, 302 and if the small portion is less than the width of the cutting edges 36, 36*a*, 302, then the width of the first cut and the width of the second cut will, of course, be limited to the width of the small portion of the nail 324.

As the simultaneous progressive deepening of the first cut and of the second cut continue, eventually the first cut and the second cut will intersect. When that occurs the opposing cutting edges (36 and 36*a* or 302 and 302) will contact each other along the entire length (either linear or curved) of the cutting edges 36, 36*a*, 302. When the first cut and the second cut intersect and contact between the opposing cutting edges 36, 36*a*, 302 occurs, the cutting edges 36, 36*a*, 302 will abut one-another. There is no overlapping of the cutting edges 36, 36*a*, 302 that occurs. Therefore, cutting of the nail 324 does not occur by an overlapping shear type of cutting action or by an overlapping scissor-type of cutting action.

Therefore, a cutting of the nail 324 by use of the nail clipper 10, 50, 100, 150, 200, 250, 400, 500 does not begin at a point on a first side of the nail 324 and progress toward an opposite second side of the nail 324, as would occur with a scissor or shear type of cut. This is because a point of intersection that occurs between a pair of overlapping scissor or shear blades progresses in a linear direction as the scissor or shear blades are progressively pivoted from a fully open position into a fully closed position.

All embodiments of the nail clipper 10, 50, 100, 150, 200, 250, 400, 500 include a type of cutting action that occurs simultaneously across the width of the cutting edge 36, 36*a*, 302.

When the cutting edges 36, 36*a* 302 are in contact with each other (i.e., when the first cut and the second cut have intersected) this position represents a closed state of the nail clipper 10, 50, 100, 150, 200, 250, 400, 500. Conversely, when the cutting edges 36, 36*a*, 302 are disposed maximally apart from each other the nail clipper 10, 50, 100, 150, 200, 250, 400, 500 is disposed in an open state.

The portion of the nail to be removed is severed when the first cut and the second cut intersect. Just prior to the intersection of the first cut and the second cut, the force tending to urge the portion that is being removed away from the remainder may be sufficient to urge the portion that is being removed sufficiently far away from the remainder of the nail 324 as to finish severing of the nail a moment before the cutting edges 36, 36*a*, 302 actually come into contact with and abut each other. The sudden drop in resistance causes an acceleration of the two cutting edges 36, 36*a*, 302 to occur as they move toward each other. When contact occurs an audible snap may, at times, be heard.

Also, as all versions of the nail clipper 10, 50, 100, 150, 200, 250, 400, 500 accomplish the desired cutting action by the two opposing blades 34, 34*a*, 106, 152, 202, 300, 301 there is no need for the inclusion of any additional cutting blade. Accordingly, the nail clipper 10, 50, 100, 150, 200, 250, 400, 500 does not include any additional cutting blades that are used or otherwise attached to it other than the first cutting blade and the second cutting blade 34, 34*a*, 106, 152, 202, 300, 301.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improvement to a nail clipper that includes a pair of opposing blades and wherein each opposing blade includes a cutting edge and wherein the cutting edges are parallel with respect to each other and wherein the cutting edges abut each other when the opposing blades are maximally urged toward each other, and wherein the cutting edges do not overlap each other, and wherein when a finger nail or a toe nail is disposed between the opposing blades and the opposing blades are urged toward each other with the nail disposed there-between, a first cutting edge severs a first side of a nail along the longitudinal length of the first cutting edge and a second cutting edge simultaneously severs a second side of the nail; wherein the improvement comprises:

a safety bumper attached proximate to one or both of the cutting edges, wherein the safety bumper includes a protrusion that extends a predetermined distance forward from the cutting edge in a direction that is generally toward the fingernail or toenail that is being cut, and wherein the protrusion limits an amount the nail can be inserted between the cutting edges and, therefore, the amount of material that can be cut from the nail by the nail clipper; and wherein said predetermined distance that said protrusion extends forward from the cutting edge is a variable that is selected for the nail clipper to provide a desired finished length to the nail after cutting of the nail by the nail clipper is completed.

2. The improvement to a nail clipper of claim 1 including a plurality of nail clippers that, when combined together, form a set of nail clippers and wherein each of said plurality of nail clippers of said set has a different length of protrusion.

3. The improvement to a nail clipper of claim 1 wherein the blades of the nail clipper are formed of metal or ceramic and the body is formed of a plastic.

4. The improvement to a nail clipper of claim 1 including an inner bumper that is disposed between an upper member of the nail clipper and a lower member of the nail clipper and wherein the inner bumper limits the amount said upper member can be urged toward said lower member after said cutting edges have come into contact with one-another.

5. The improvement to a nail clipper of claim 4 wherein said inner bumper includes a pair of inner bumpers, and wherein a first of said pair of inner bumpers is attached to an inside of said upper member and wherein a second of said pair of inner bumpers is attached to an inside of said lower member.

* * * * *